US009260283B2

(12) United States Patent
Minica et al.

(10) Patent No.: US 9,260,283 B2
(45) Date of Patent: Feb. 16, 2016

(54) HANDLE INITIATED ELECTROMECHANICAL MULTI-FLAVOR BEVERAGE DISPENSER

(71) Applicant: Schroeder Industries, Inc., San Antonio, TX (US)

(72) Inventors: Jason Minica, Schertz, TX (US); Deborah Absalon, Converse, TX (US); A. A. Jud Schroeder, San Antonio, TX (US); David Santy, Converse, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 184 days.

(21) Appl. No.: 13/767,561

(22) Filed: Feb. 14, 2013

(65) Prior Publication Data

US 2013/0206793 A1 Aug. 15, 2013

Related U.S. Application Data

(60) Provisional application No. 61/598,508, filed on Feb. 14, 2012.

(51) Int. Cl.

| | |
|---|---|
| ***B67D 1/00*** | (2006.01) |
| ***B67D 1/08*** | (2006.01) |
| *B67D 1/12* | (2006.01) |

(52) U.S. Cl.

CPC ..... *B67D 1/0037* (2013.01); *B67D 1/0085* (2013.01); *B67D 1/0888* (2013.01); *B67D 1/1243* (2013.01)

(58) Field of Classification Search

CPC .. B67D 1/0037; B67D 1/0888; B67D 1/0085; B67D 1/1243; B67D 1/0081

USPC ..... 222/129.1, 129.3, 129.4, 135, 145.5, 222/145.1

See application file for complete search history.

(56) References Cited

U.S. PATENT DOCUMENTS

| | | | | |
|---|---|---|---|---|
| 5,433,348 | A * | 7/1995 | Deering et al. | 222/129.1 |
| 5,960,997 | A * | 10/1999 | Forsythe | 222/129.3 |
| 6,685,059 | B2 * | 2/2004 | Jones et al. | 222/129.1 |
| 6,689,410 | B2 * | 2/2004 | Gerber | 426/565 |
| 7,624,895 | B2 * | 12/2009 | Haskayne | 222/129.1 |
| 7,878,370 | B2 * | 2/2011 | Sevcik et al. | 222/1 |
| 2007/0215239 | A1 * | 9/2007 | Dorney | 141/94 |
| 2010/0187258 | A1 * | 7/2010 | Santy et al. | 222/129.1 |
| 2012/0055954 | A1 * | 3/2012 | Hecht | 222/129.1 |

* cited by examiner

*Primary Examiner* — Kevin P Shaver
*Assistant Examiner* — Robert Nichols, II
(74) *Attorney, Agent, or Firm* — Jackson Walker, LLP

(57) ABSTRACT

Multi-flavored beverage dispensing may be achieved by a variety of systems, processes, and techniques. In certain implementations, a system for dispensing a combination of externally supplied flavor concentrates and water may include a housing, a lid, a base, a valve, and a flow control assembly. The valve may include a dispensing nozzle, a handle, and a sensor activated by movement of the handle, the valve adapted to separately receive a flavor concentrate and water and mix the two fluids in the nozzle before dispensing. The flow control assembly may include a multiplicity of paired mechanically adjustable flow control elements and dispensing controllers. The flow control assembly may be controlled by a touch-sensitive control panel and a computer. The touch-sensitive control panel may be adapted to receive user flavor selections, and the computer may control the dispensing controllers responsive to user touches of the control panel and manipulation of the handle.

20 Claims, 24 Drawing Sheets

HANDLE INITIATED ELECTROMECHANICAL MULTI-FLAVOR BEVERAGE DISPENSER

RELATED APPLICATIONS

This application claims priority to U.S. Patent Application No. 61/598,508, entitled "Handle Initiated Electromechanical Multi-Flavor Beverage Dispenser" and filed on Feb. 14, 2012, which is herein incorporated by reference.

FIELD OF THE INVENTION

This disclosure relates to beverage dispensers and, more specifically, to a multi-flavor beverage dispenser whose multi-featured dispensing is activated by manual engagement with a changeable touch screen display.

BACKGROUND OF THE INVENTION

This application incorporates by reference U.S. patent application Ser. No. 12/286,441, filed Sep. 30, 2008, claiming the benefit of U.S. Provisional Application Ser. No. 60/997,070, filed Oct. 1, 2007.

Beverage dispensers are known in the prior art which post-mix a beverage in a nozzle of a valve. Typically, these beverage dispensers provide a multiplicity of flavored syrups or concentrates, such as bag-in-a-box, and a pressurized water source, such as city water, to the dispenser valve. The dispenser receives the pressurized fluids and, through flow control means known in the art, provides the beverages to either a bar gun handle with a multiplicity of buttons or to a valve.

Typically, manual switches activate solenoids which in turn dispense the beverage from one or more dispensing nozzles mounted on a dispenser housing. In other embodiments, a lever operated mechanical switch located beneath a multiplicity of nozzles, one for each flavor, is manually activated, typically by the surface of the handheld cup, and the switch action actuates a solenoid which provides for a carbonated beverage dispensed into the cup.

SUMMARY OF THE INVENTION

Applicants provide a handle initiated electromechanically operated beverage dispenser adapted to dispense a multiplicity of beverages, chosen from a touch screen or other display type screen, from a single valve in a post-mix operation. In certain implementations, the beverage dispenser may provide little or no "carryover" in flavor from one beverage to the next. Additionally, the beverage dispenser may use only DC power inside its housing, which may increase its safety.

Applicants provide in a post-mix valve a reed type switch, a Hall effect sensor, or other sensor, adapted to engage the handle of a T-valve or other suitable valve, the valve and handle adapted to provide the "feel" of a manual dispensing operation, yet whose sensor opens a solenoid upstream of the mixing valve. This activation provides for the post-mixing of a control screen selected one of a multiplicity of beverages and plain or carbonated water into a container.

By combining the "look and feel" of a manually operated post-mix valve, for example, that described in the '441 application, Applicants provide for a combination of electronic control with the "look and feel" of manual control, providing the consumer with the familiarity of a handle operated mechanical dispensing beverage dispenser with the convenience and adaptability of the flow controlled multiplicity of beverages, all in the nozzle that will prevent carryover from one flavor to another.

BRIEF DESCRIPTION OF THE DRAWINGS

FIG. 2A is a perspective view of a quick disconnect assembly for use with the beverage dispenser.

FIGS. 5A-5C illustrate three screen appearances for the touch activation of the control panel.

DETAILED DESCRIPTION OF PREFERRED EMBODIMENTS

Figure 1:
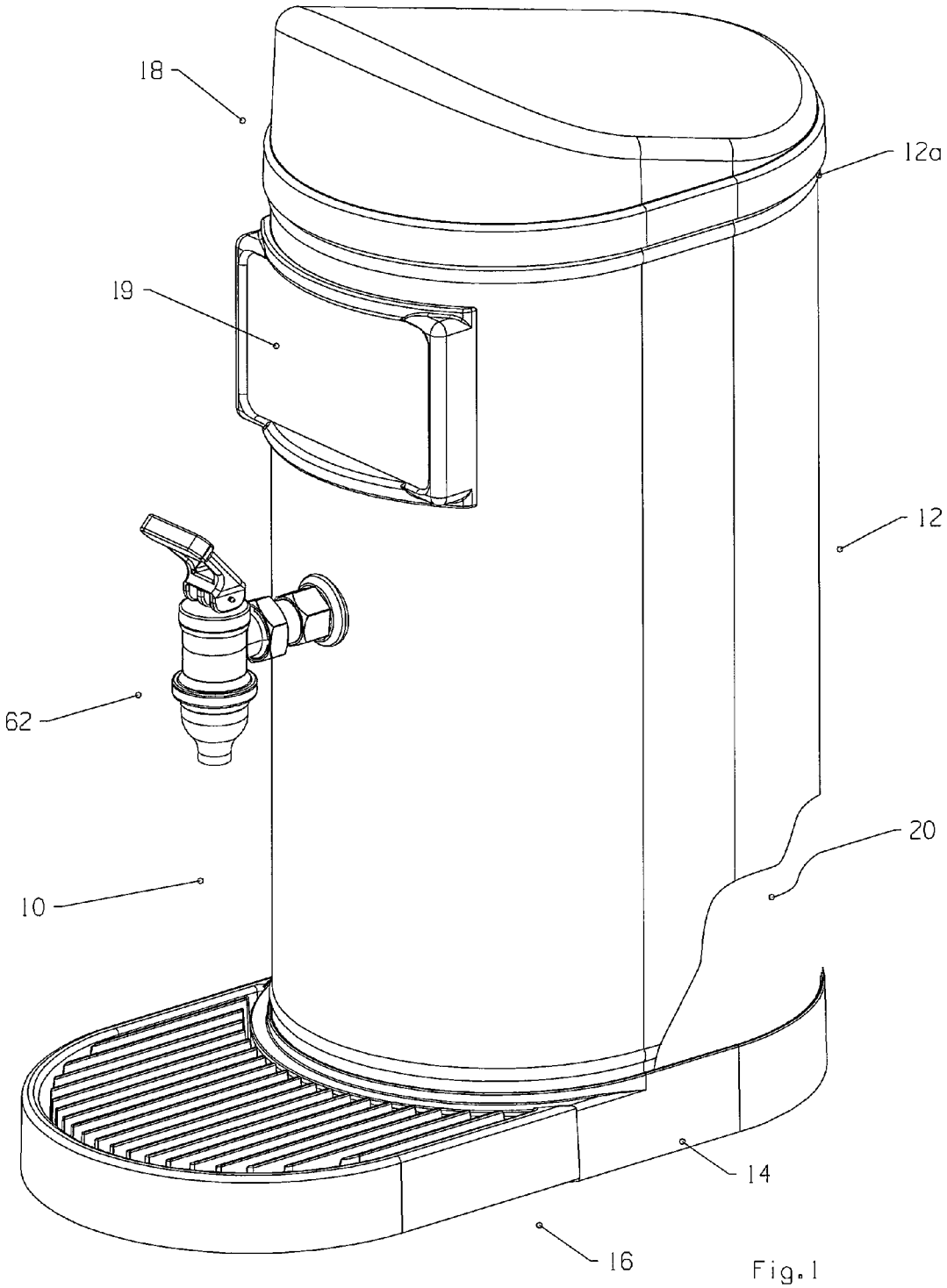
FIG. 1 is an isometric external view of the front right-hand top side of an example beverage dispenser.
Figure 1A:
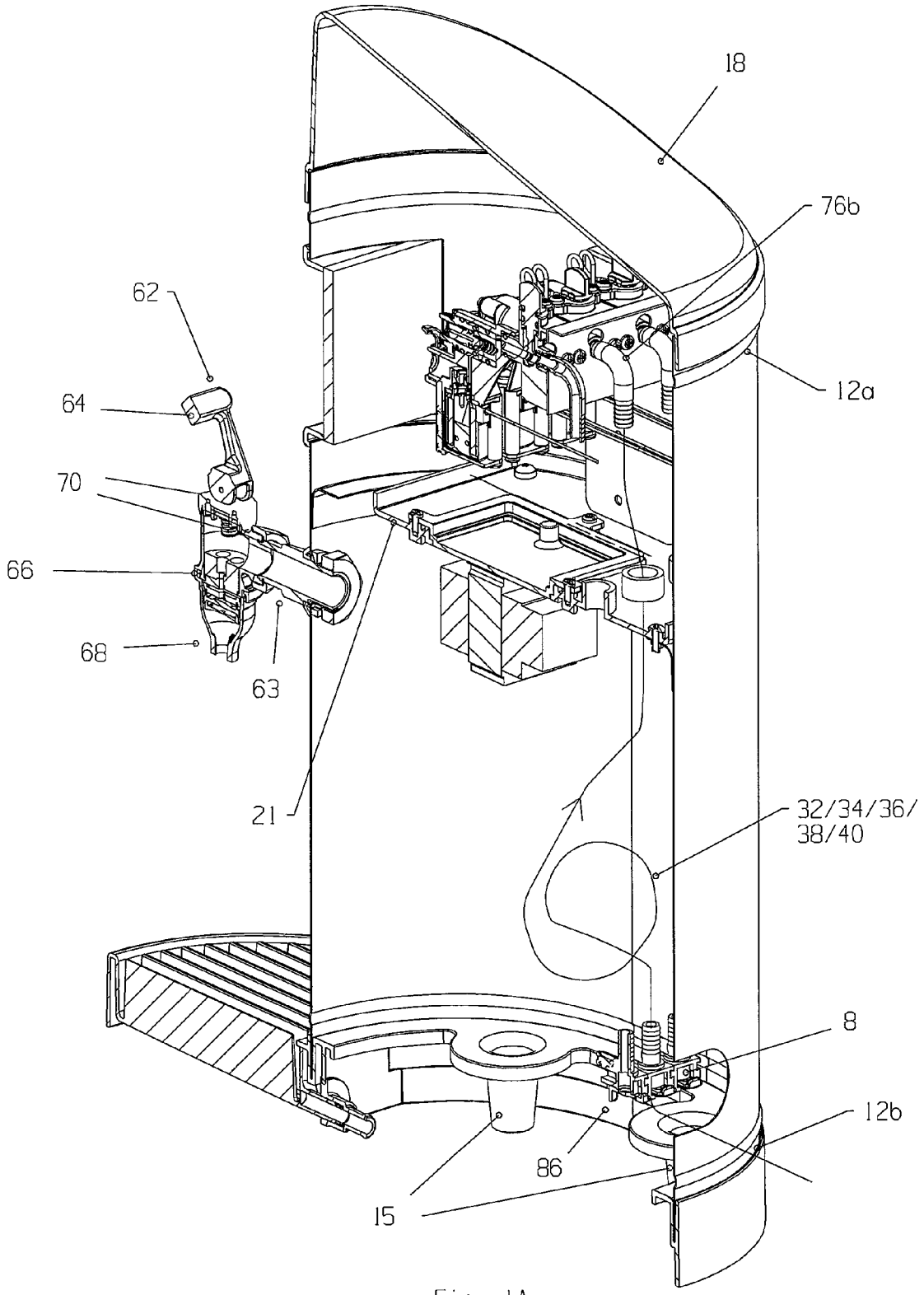
FIG. 1A is a cutaway cross-sectional perspective view showing the interior of the example beverage dispenser.
Figure 1B:
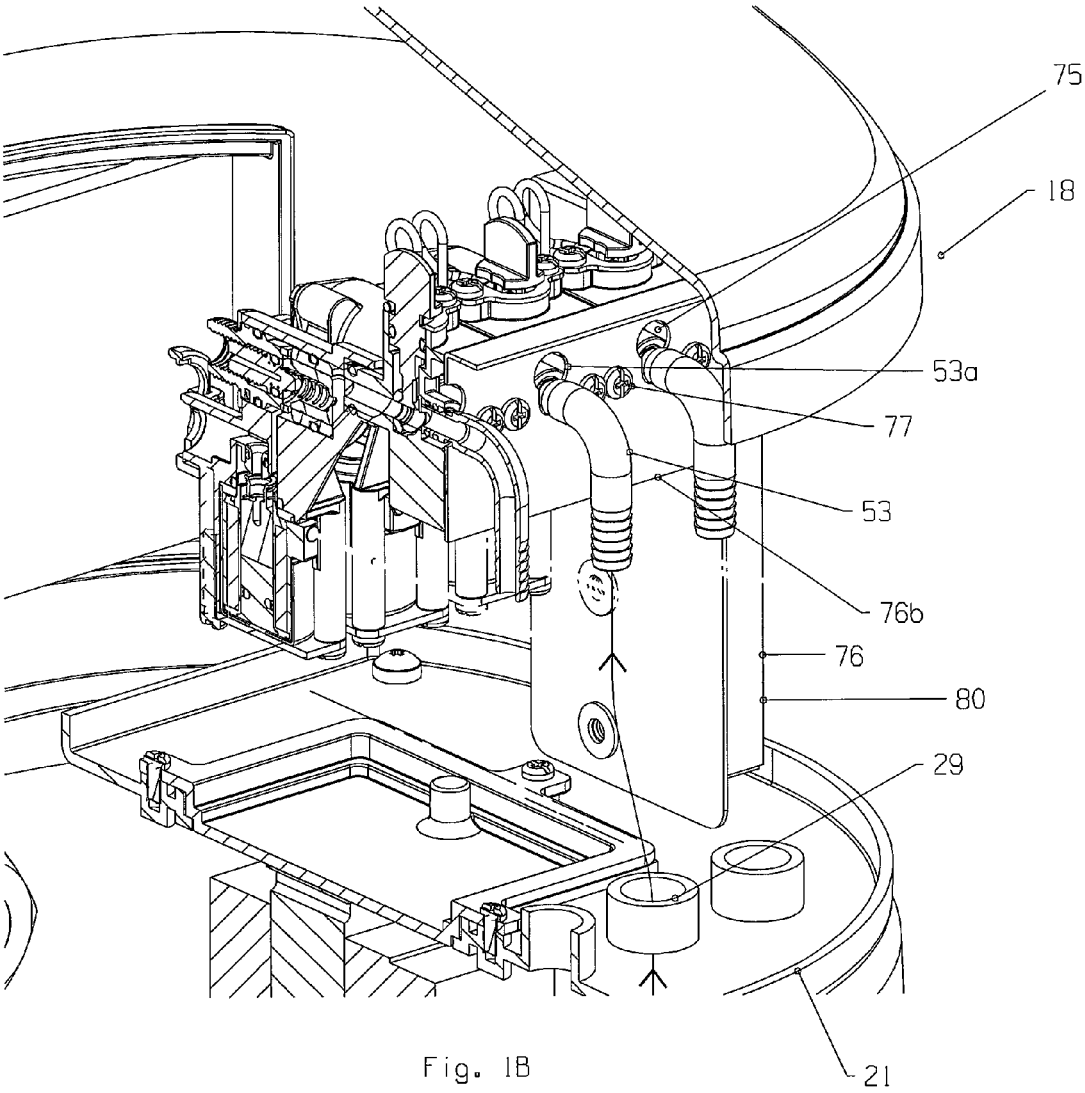
FIG. 1B is a detailed cross-sectional perspective view of the manner in which modular flow control elements engage their housing.
Figure 1C:
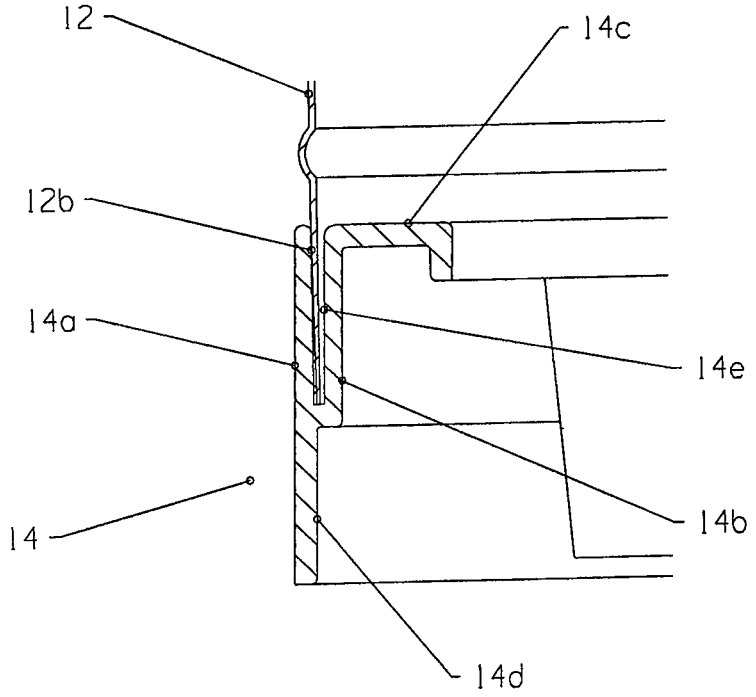
FIG. 1C is a partial cutaway view of the manner in which the lower perimeter of the housing meets the base.
Figure 1D:
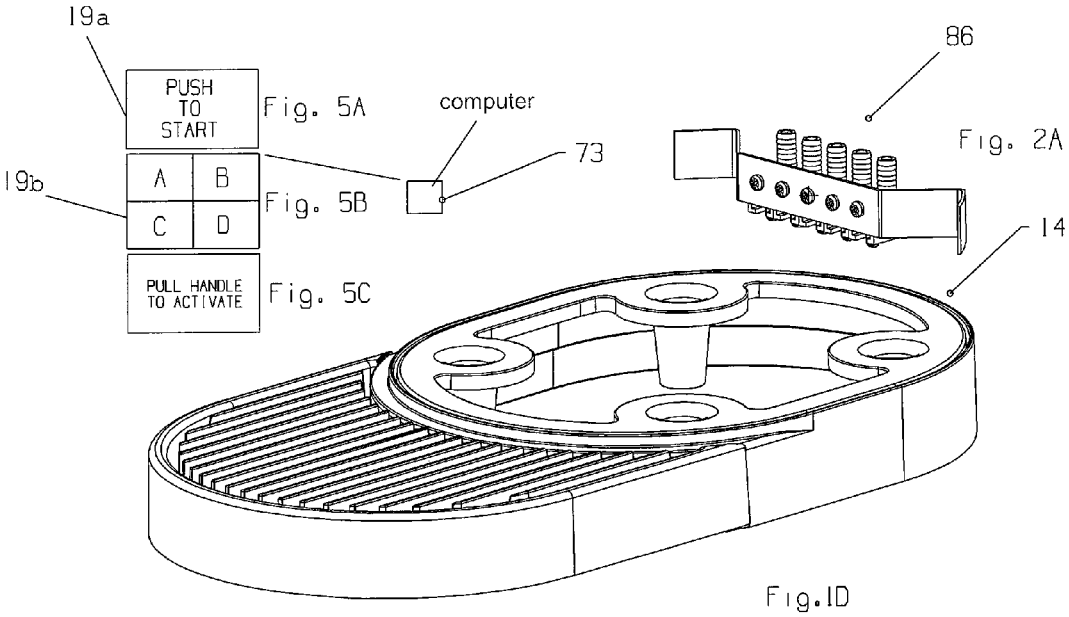
FIG. 1D is an isometric view of the base.

FIGS. 1-1D illustrate an example beverage dispenser 10. Beverage dispenser 10 includes a housing 12, a base 14, the base having a multiplicity of legs 15 depending therefrom and a drip tray 16 laterally extending therefrom, and a lid 18 configured to engage a top perimeter of housing 12. In certain implementations, legs 15 may receive screws and anchor the base to a support surface (e.g., a counter). The external appearance of beverage dispenser 10 illustrates the use of an electronic control screen or panel 19 operable as set forth in more detail below, combined with, typically, a post-mix valve 62, such as a T-handled post-mix valve having an inlet 63, a handle 64 extending upward from a body 66 and a nozzle 68 extending downward from the body. Post-mix valve 62 is seen to have a general "T"-shape, wherein the leg of the "T" is represented by inlet 63 and the handle 64, body 66, and nozzle 68 are aligned perpendicular to the inlet or leg. This post-mix valve mimics a manual dispensing valve, such as those found in US Patent Publication Nos. 2011/0167918; 2010/0187258; and 2011/0042415 (all assigned to Applicants herein), which are incorporated by reference herein.

Housing 12 defines an interior 20, in which some elements of the beverage dispenser, more specifically set forth below, are located. Turning to the other elements typically exterior to housing 12, beverage dispenser 10 is adapted to engage a multiplicity of flavor concentrates, such as bag-in-box "BIB" pressurized flavors, here, four illustrated with numerals 22/24/26/28. Further, beverage dispenser 10 is adapted to engage a pressurized water source, such as city water 30. Flavor lines 32/34/36/38 are provided to engage the multiplicity of bag-in-box flavor sources and a water line 40 is provided to engage city water 30 or other source of pressurized water through quick disconnect assembly 86 (see FIG. 2A). Lines 32/34/36/38/40 are adapted to provide fluid to nozzle 68 through flow control elements 42/44/46/48/50, so that flow controlled water/concentrate is provided to nozzle 68 in a specific mix ratio adapted or designed to provide the specific mix of concentrate and water as known in the art. As illustrated, flow control elements 42/44/46/48/50 include screw-type mechanical adjusters to adjust the flow therethrough. Flow control elements 42/44/46/48/50 also engage dispensing controllers 52/54/56/58/60, the latter for the control of water, which dispensing controllers may be operated by a mechanical switch 70 adapted to open or close responsive to manual input or movement of handle 64 by a user of beverage dispenser 10 generating an electronic signal to a computer 73. Dispensing controllers 52-60 may, for example, be solenoids.

Computer 73 typically includes a processor and memory. A processor may, for example, be a microprocessor, a microcontroller, or any other device that can manipulate information in a logical manner. Memory may, for example, include disk memory, solid-state memory, and/or any other appropriate type of information storage device. In particular implementations, memory may include random access memory (RAM), read only memory (ROM), and/or programmable read only memory (PROM). Memory may hold instructions and/or data for the processor.

In certain implementations, beverage dispenser 10 may also include a number of user output devices and user input devices. User output devices may include gauges, displays, read outs, or any other type of device by which information may be communicated to a user. For example, beverage dispenser may have a display that indicates what mode the dispenser is in. User input devices may include dials, keypads, touch screens, switches, or any other types of devices by which a user may input information to the beverage dispenser. For example, beverage dispenser 10 may include a switch for activating beverage dispensing. The switch may work in conjunction with the handle.

Beverage dispenser 10 may receive electrical power to operate the electronics therein (e.g., computer 73 and dispensing controllers 52/54/56/58/60). In particular implementations, electrical power for beverage dispenser 10 may be provided by converting standard commercial AC power (e.g., 120 V) to DC power (e.g., 24 V). The electrical power may be converted by a power transformer (e.g., a rectifier) that is external to housing 12. Although the internal components of beverage dispenser 10 should not leak, a leak is still possible. Thus, it is safer to deliver DC power inside the beverage dispenser. As illustrated in FIG. 1A, a power transformer could also be included in housing 12.

Figure 2:
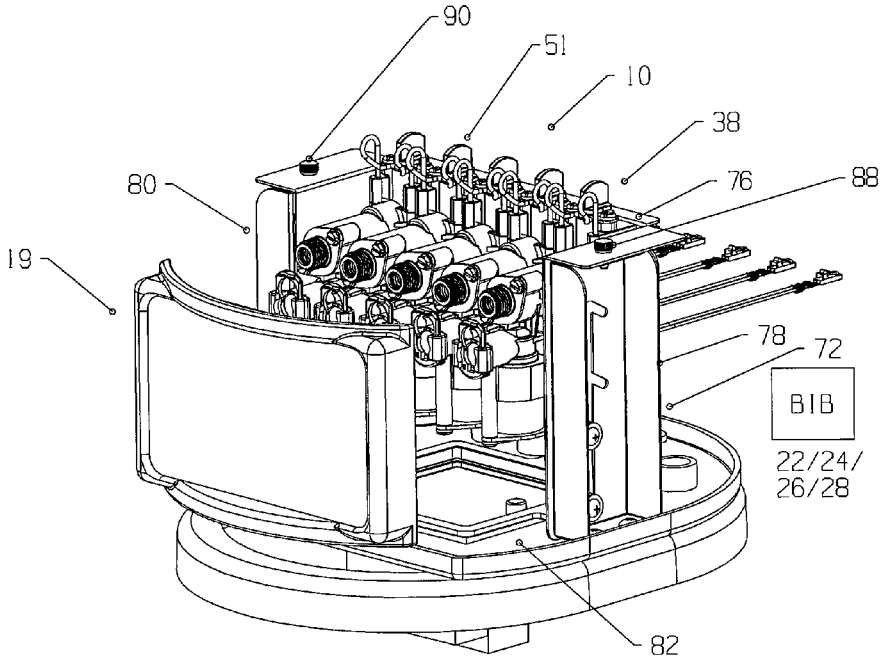
FIG. 2 is an isometric view of fluid flow elements of the beverage dispenser assembly.
Figure 3:
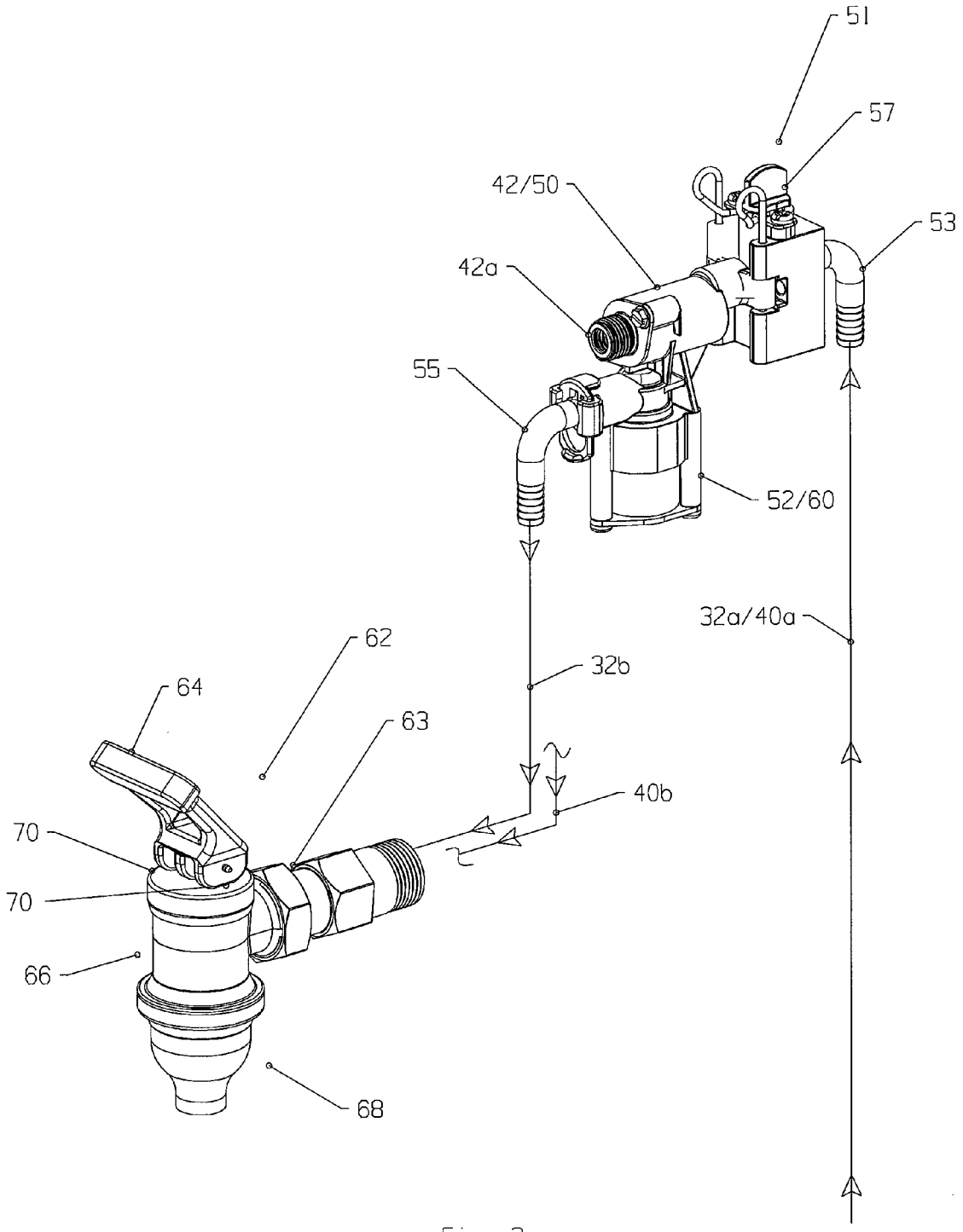
FIG. 3 is an exploded partial perspective view of elements of a fluid circuit for use in the example beverage dispenser.

With reference to FIGS. 2, 3, 7A, 7B, and 7C, additional features of beverage dispenser 10 may be seen. FIG. 3 illustrates an example flow control subassembly 51, including an integral unit having sequentially an on/off switch 57, flow control element 42/44/46/48/50, and dispensing controllers 52/54/56/58/60. Flow control subassembly 51 may have an inlet elbow 53 engaging an inlet port and an outlet elbow 55 engaging an outlet port with clips associated therewith to toolessly, lockingly engage the elbows to the subassembly. Flow control subassembly 51 is seen to control the flow of fluid with the flow control elements typically being adjustable in ways known in the art, dispensing controllers being on/off and electronically actuated in ways known in the art, and the on/off valve 57 manually operated in ways known in the art. Manual on/off valve 57 is intended for use by a service technician who may service elements downstream thereof upon closure. In certain implementations, flow control elements 42/44/46/48/50 and dispensing controllers 52/54/56/58/60 do not have to be assembled with each other.

Figure 7A:
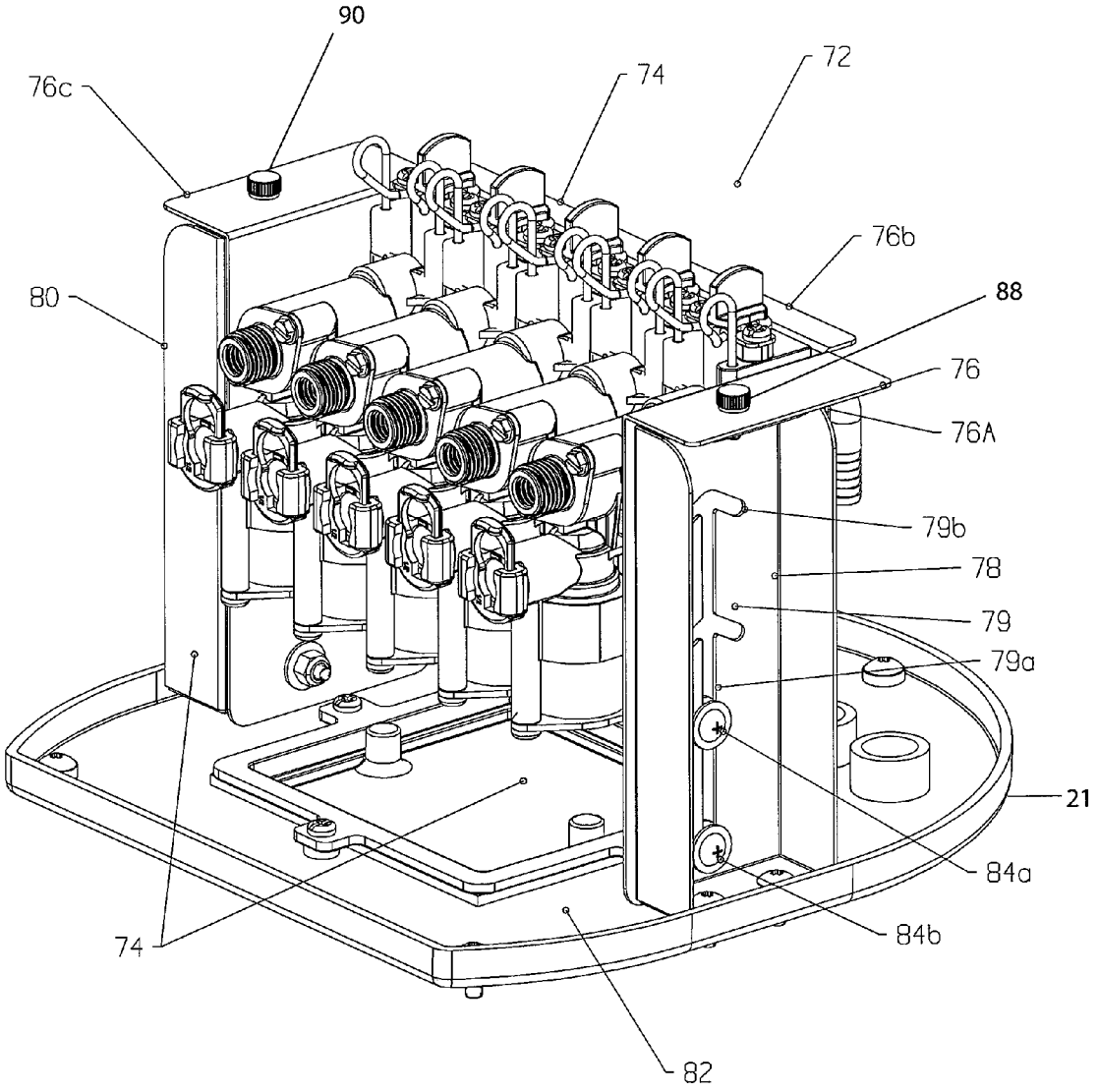
FIG. 7A is a perspective view of a flow control assembly in a lower position.
Figure 7B:
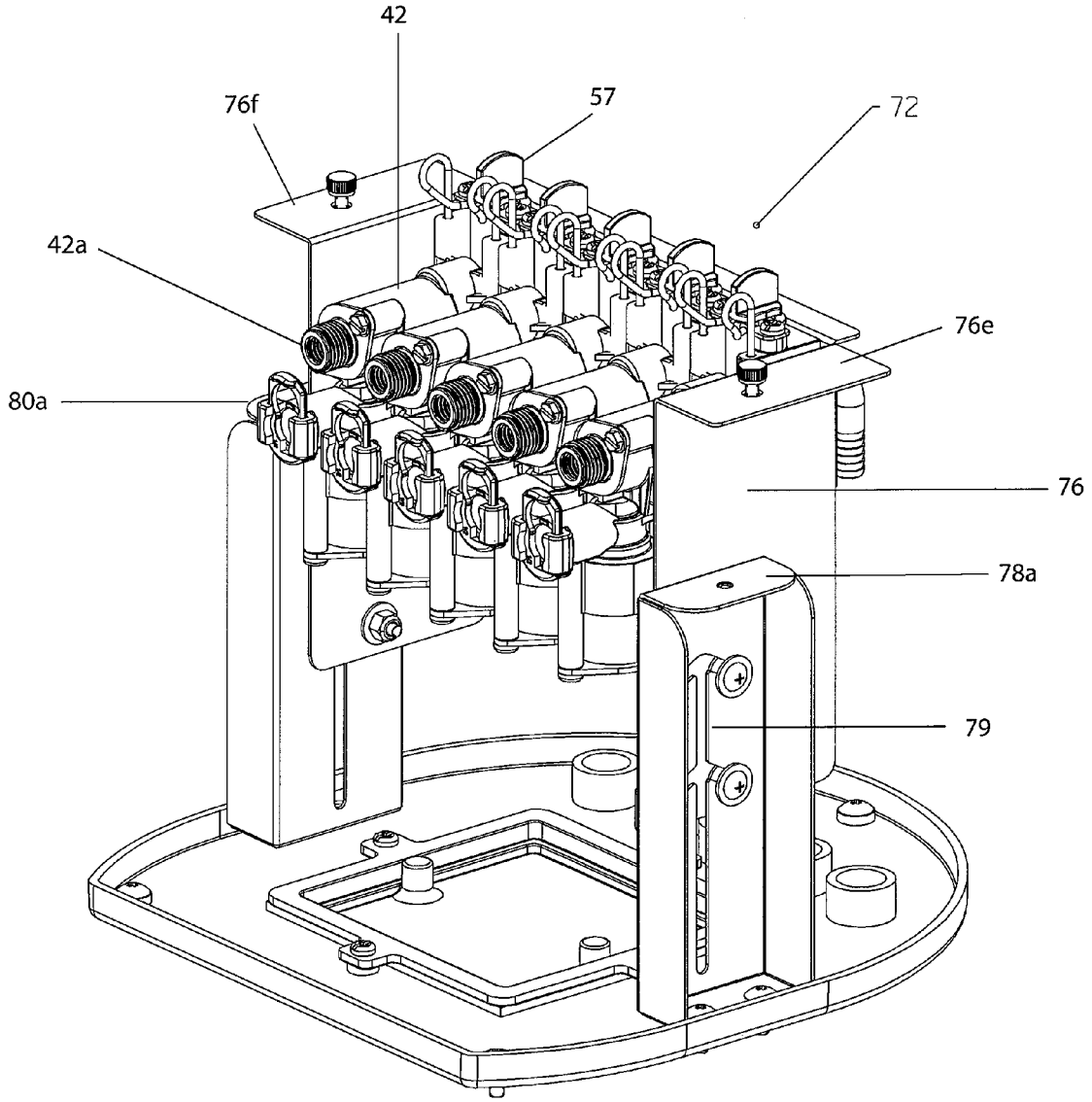
FIG. 7B is a perspective view of the flow control assembly in a raised position.
Figure 7C:
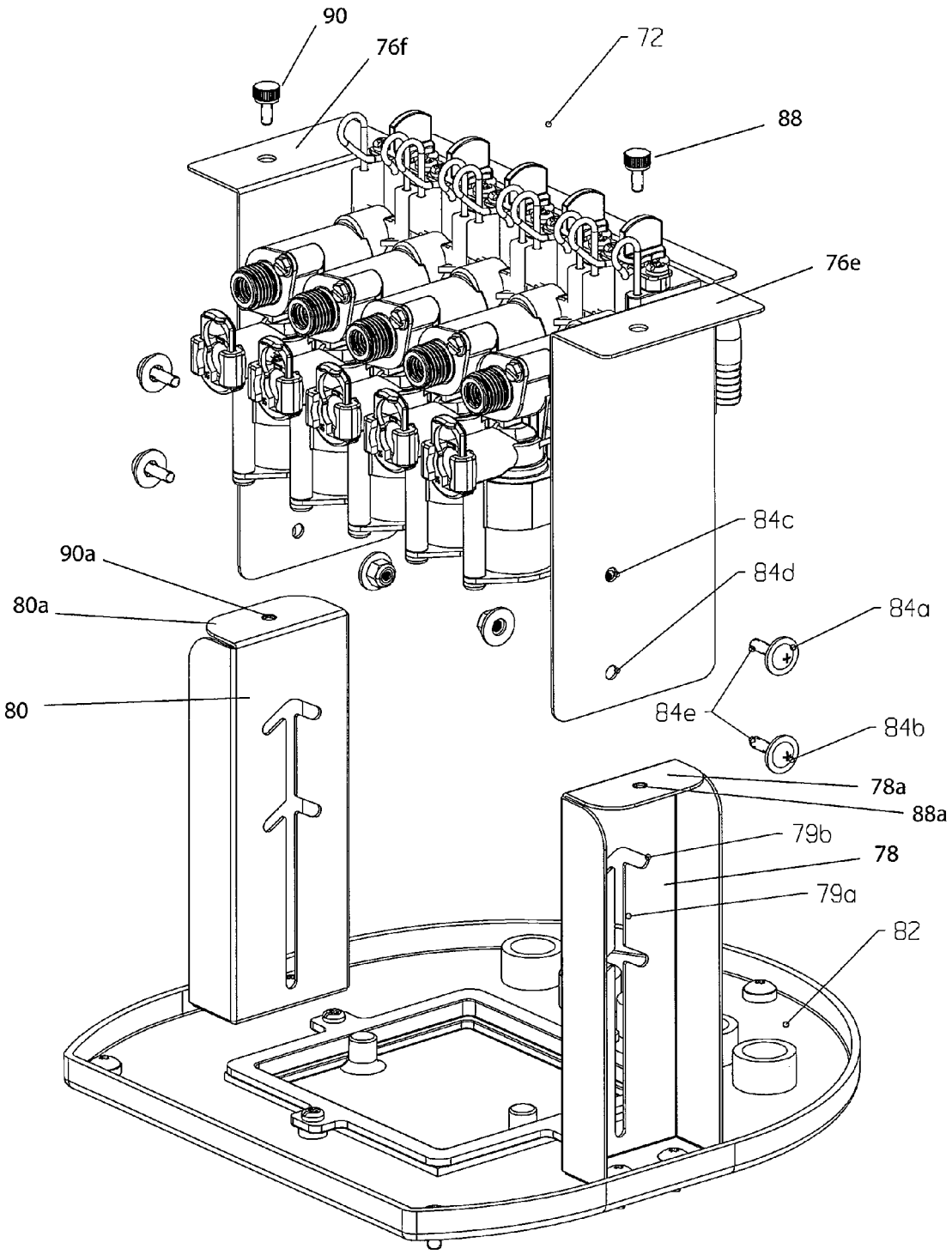
FIG. 7C is an exploded perspective view of the flow control assembly.

In FIGS. 2, 7A, 7B, and 7C, it is seen that a multiplicity, here, five, of flow control subassemblies may be engaged to create an integral subassembly flow control module with the individual assemblies 51 aligned therewith, such that the dispensing controllers, the flow control elements, and the on/off switches are all aligned and service accessible. The flow control subassemblies may be fixedly engaged to a housing 76. In this implementation, housing 76 includes three walls, side walls 76*a*/76*c*, and back wall 76*b*. The back wall is configured to receive the inlet elbows 53 therethrough and side walls 76*a*/76*c* configured to receive securement screws 84*a*/84*b* therein at threaded portions 84*c*/84*d*. Moreover, it is seen that the engagement of the flow control subassemblies with housing 76 creates a drop-in flow control assembly 72 that may engage holding brackets 78/80, the brackets dimensioned to lay flush against walls 76*a*/76*c*. Moreover, brackets 78/80 are slotted having slots 79 in each bracket 78/80, slots 79 having a vertical portion 79*a* and one or more diagonal or oblique portions 79*b*. Further, slots 79 are just wide enough to receive shafts 84*e* of screws as they threadably engage threaded portions 84*c*/84*d* on side walls 76*a*/76*c*, and thus are entrained within the slots of either side wall 78/80. When screws 84*a*/84*b* are so entrained, they may be tightened for shipping the dispenser, and loosened to allow the drop-in flow control assembly 72, with subassemblies 51 screwed into rear wall 76*b* of housing 76, to slide vertically up and down. Moreover, as seen in FIG. 7B, drop-in flow control assembly 72 may be held in a raised position when the screws are in diagonal slots 79*b*, which allows easy access to the adjusting elements, for example, adjustable element 42*a* of flow control element 42, on/off switch or valve 57, and the remaining adjusting elements of the remaining flow control modules. Typically, raising of assembly 72 allows the adjusting elements 42*a* of the flow control elements 42/44/46/48/50 to be above upper lip 12*a* of housing 12. In FIGS. 7A-7B, it is seen that easily accessible thumbscrews 88/90 may be used to lock down or release element 72 (FIG. 7A) in a use (FIG. 7A) position. Thumbscrews 88/90 go through top plates 76*e*/76*f* and into legs 78*a*/78*b* that have threaded portions therethrough.

Assembly 72 and brackets 78/80 provide easy servicing of beverage dispenser 10. Note the top location, easy accessibility (with lid 18 removed) of thumbscrews 88/90, which may be loosened by hand. Assembly 72 may then be elevated, the flow control elements serviced, and assembly 72 dropped down and locked in by manually threading (no tools) thumbscrews 88/90 down.

Brackets 78/80 are illustrated as fixedly engaging subfloor or platform 21, which is raised above base 14. In certain embodiments, platform 21 is raised above the position of post-mix valve 62, as best seen in FIG. 2.

Figure 2B:
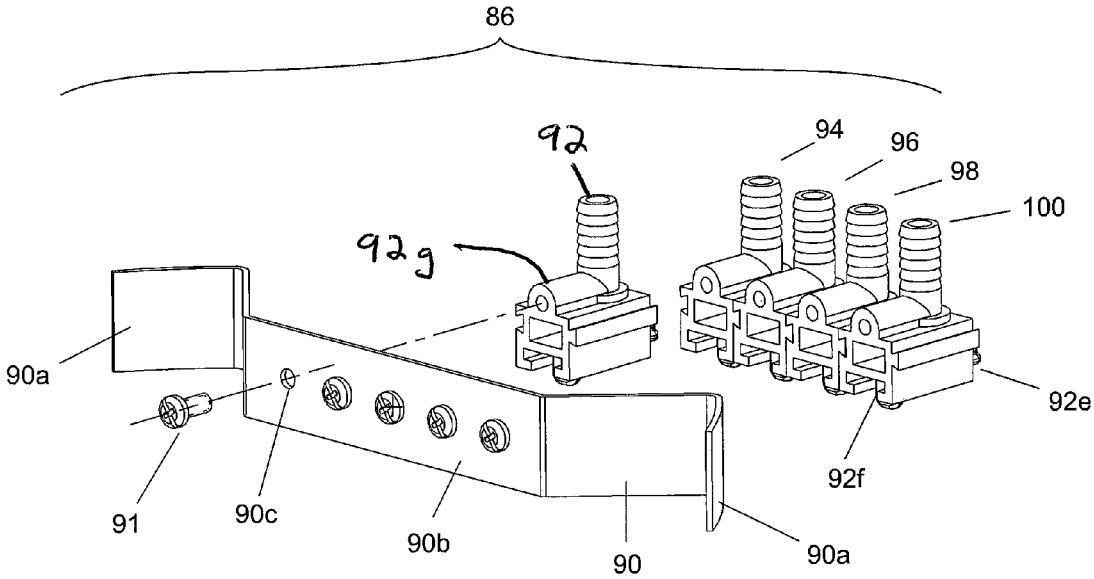
FIG. 2B is an exploded perspective view of a quick disconnect assembly.
Figure 2C:
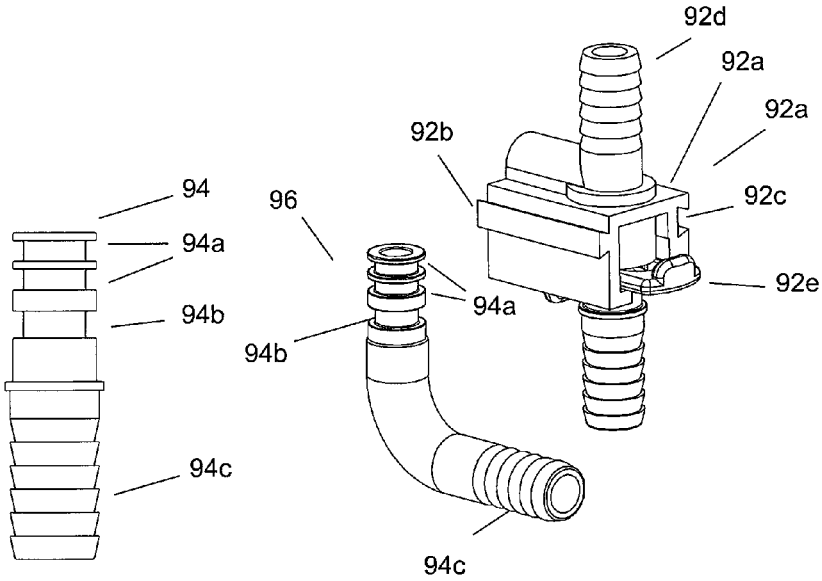
FIG. 2C are views of a quick connect component and its connectors.

FIGS. 2A-2C illustrate an example quick disconnect assembly 86. Quick disconnect assembly 86 functions to provide a rigid, aligned unitized structure for quick receipt of incoming fluid lines from a pressurized fluid source external to the assembly and connecting those incoming lines in quick disconnect fashion through connectors 94 (straight) or 96 (elbow) to lines internal to the system. Quick disconnect assembly 86 is seen to comprise a quick disconnect bracket 90 for threadably engaging through fasteners 91, a multiplicity of quick connect elements 92/94/96/98/100. Bracket 90 is seen to have wings 90*a* on either end thereof dimensioned to be welded, screwed, or otherwise fastened to the inner walls of housing 12, as well as a body 90*b* for receiving fasteners 91 on one side thereof and quick connect elements 92/94/96/98/100 on the other side thereof.

Quick connect elements 92/94/96/98/100 are similarly constructed, and one will be illustrated in detail, here, element 92. With reference to FIGS. 2B and 2C, it is seen that quick connect elements function to engage in a connected and aligned manner bracket 90, as well as engage incoming fluid lines and engage those fluid lines to internal fluid lines carrying fluid to the individual flow control elements 51 as set forth hereinabove. Moreover, it will be seen that quick connect elements can toolessly engage the incoming fluid lines either from the rear, using elbow connector 96, or incoming fluid lines coming up from the base below using straight connector 94.

Quick connect elements are seen to include a body 92*a*, which is configured to have a female inlet port below (not shown) and an outlet male member 92*d* configured to extend upward therefrom. The side walls of body 92*a* may be configured with a male 92*b* and a female 92*c* connectors configured to slideably engage one another to hold the quick connect elements 92/94/96/98/100 in adjacent alignment for easy fastening to bracket 90. A captured clip 92*e* is configured on walls of body 92 to slide back and forth to engage connector locking slots 94*b* depending on the connector type chosen. Fastener receiving walls 92*g* are seen to abut the walls opposite fasteners 92 of body 90*b* as seen in FIG. 2B. As seen in FIG. 2C, connector elements 94/96 may receive O-rings (not shown) in slots 94*a* thereof and may receive pliable tubing as known in the art on wall portions 94*c*.

In certain implementations, a quick connect assembly may not be used. For example, the quick connect elements could be loose inside housing 12. Also, quick connect elements may not be used at all.

Figure 4:
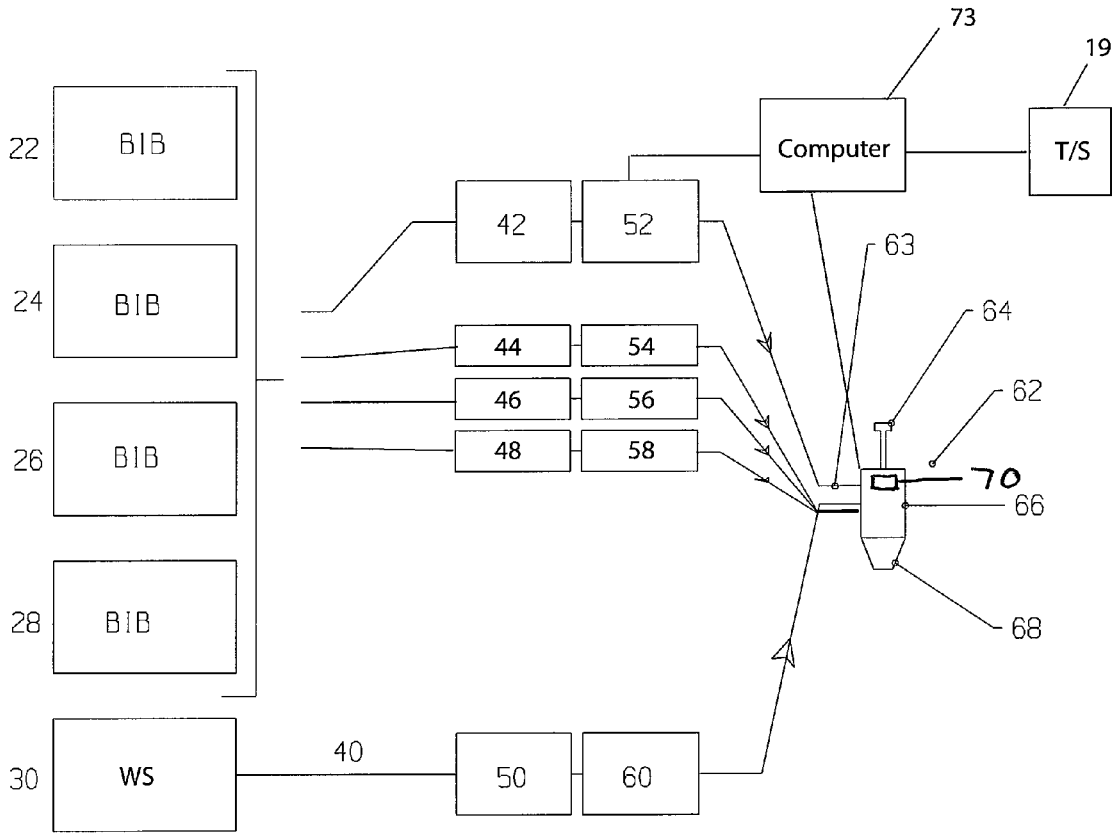
FIG. 4 is a schematic view of fluid flow paths for the example beverage dispenser.

Turning now to FIG. 4, a layout of the elements of the fluid circuit is indicated as set forth herein. Moreover, as seen with reference to FIG. 4, four beverage flavors as well as the water supply, are controlled from an electronic sensor 70 manually engaged with a valve handle, which sensor is electronically engaged with computer 73 to open and close the dispensing controllers 52/54/56/58/60 in one of the desired flavor lines responsive to the operation of handle 64, the user selected flavor responsive to the user's touch or other input on touchscreen 19, which is also conveyed to computer 73.

Touchscreen 19 may be a touch membrane, a capacitive touchscreen, a resistive touchscreen, or any other appropriate touch-sensitive device. Touchscreen 19 may display text and/or graphics associated with various parts of the touchscreen, which correspond to different beverage flavors (e.g., regular, sweetened, decaffeinated, etc.).

Figure 6:
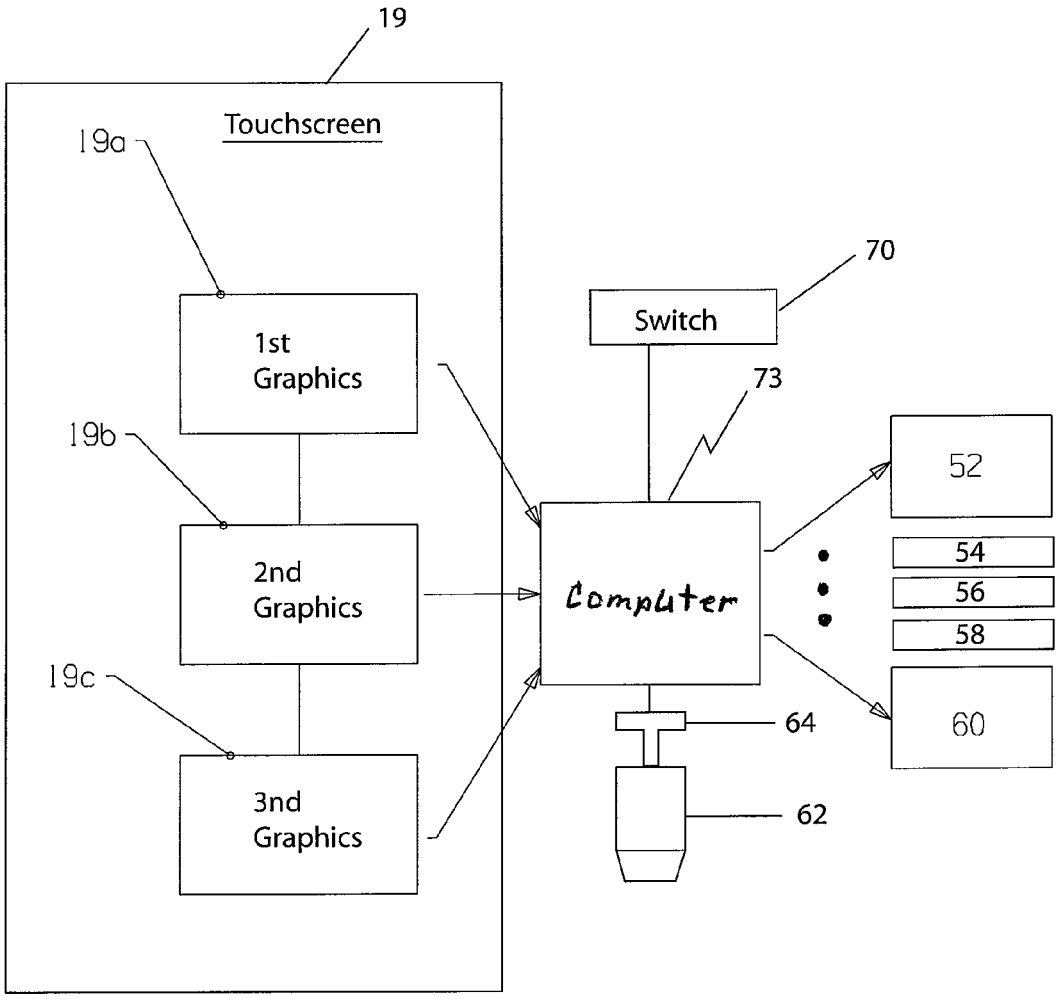
FIG. 6 illustrates electrical control circuits the example beverage dispenser.

Turning now to FIGS. 5A, 5B, 5C, and 6, a user's manual input, such as a "push to start" touch screen carrying a "push to start" screensaver prompt 19*a*/FIG. 5A, may initiate a four quadrant, four flavor "pick the product" screen prompt 19*b*/FIG. 5B, such as a screen displaying products A/B/C/D, one in each quadrant as set forth in FIGS. 5B and 6. Touching one of the four quadrants may send a signal to computer 73, which may, having been awoken with the push to start operation, enter a ready state for receipt of a signal from screen 19*b* for prompting one of four flavor selections. After a flavor selection, computer 73 may wait for receipt of a signal from the handle for prompting dispensing. Optionally, a third screen 19*c*/FIG. 5C may come up instructing the user to pull the handle to activate or optionally a flavor strength prompt may be displayed on the control panel providing a weak, medium or strong beverage selection, initiated by a touch of the screen broken up into, for example, three sections. In any case, sequential manual operation 19*a*/19*b*/19*c*/19*n* of electronic control panel 19 prompts to the computer initiated by, for example, touch screen control on the control panel 19, may prompt the computer for receipt of a signal from an electromechanical sensor (e.g., a reed switch) engaging the handle of the post-mix valve 62. The user may then pull the handle as in a normal mechanical dispensing operation and the computer will, in receipt of the signal therefrom, send open signals to the selected flavor dispensing controller and the water dispensing controller and may further provide for a "time to close" signal to the selected dispensing controllers (water and concentrate selected).

Computer 73 may be pre-programmed for a "time to close" signal, upon opening of the dispensing controllers or may be programmed to be responsive to close the dispensing controllers through the closing of the handle actuated switch. That is to say, the period of time that the dispensing controllers (water and flavor selected) are open may be a function of the manipulation of the handle initiated by the user's operation of the handle, or it may be preprogrammed, through, for example, user selected strong/medium/weak, for a preselected period of time (known container volume). In the latter case, the activation of the handle merely prompts computer 73 to initiate the preselected time for maintaining the dispensing controllers in an open condition, with the subsequent flow of the predetermined beverage quantity to the nozzle.

FIGS. 1A, 1 B, 1C, and 1D illustrate further details of example beverage dispenser 10. It is seen in these Figures, the manner in which the flow control subassemblies 51 are separately attached to the housing 76. More specifically, it is seen that housing 76 has a multiplicity of keyhole shaped cutouts 75 in the rear wall thereof. The keyhole shaped cutouts have the keyhole shape indicated with an upper larger open portion having a dependent smaller lower open portion. Inlet elbow 53 is seen to have a slot 53*a*, which will snugly engage the lower portion of cutout 75 in a manner which prevents the axial or longitudinal movement of the inlet elbow 53 and locks it in place. Fasteners 77 engage the rear wall of the flow control subassembly 51 to the back wall 76*b* of housing 76 in the manner illustrated in FIG. 1B, for example. By inserting the inlet elbow 53 through the keyhole while the subassembly 51 is slightly raised and aligning the inlet elbow with the inlet port of the subassembly allows one then to lower the subassembly with the inlet elbow nested therein, such that the slot 53*a* is snugly engaged to the walls of the lower assembly and the screw holes (not shown) in the back of the subassembly 51 line up with the fastener receiving holes in the back wall 76*b* for receipt of fasteners 77 therein. Slideable clips known in the art may further engage the inlet elbows to the subassemblies.

Turning now to the interior, it is seen that a subfloor or platform 21 separates the interior of housing 12 into an upper and lower portion. Platform 21 has holes 29 to receive a multiplicity of lines 32-40 therein, which lines may enter the interior of the housing from the rear as seen in FIG. 1A, and may loop or coil in the lower compartment as seen in FIG. 1A. This excess of line allows for the raising and lowering of subassembly module 74.

As best seen in FIG. 1C, base 14 may be configured with a pocket 14*e* dimensioned to snugly receive lower perimeter 12*b* of housing 12. Housing 12 has an upper perimeter 12*a* for engaging lid 18 and a lower perimeter 12*b* for snugly engaging base 14 to help prevent the unit from tipping. Prior art housing to base fastening systems have in some instances proved to be flimsy or unstable. Pocket 14*e* helps alleviate this condition.

Base 14 is seen to have an outer arm 14*a* extending upward and an inner arm 14*b* extending upward, the two creating a pocket 14*e* therebetween. Extending below the pocket is lower leg 14*d*, at the removed end of which typically rests on the support surface. A floor or inner lip 14*c* extends inward from the upper edge of inner arm 14*b*. There is some resiliency to arm 14*a* such that the pocket is slightly narrower than the thickness of lower perimeter 14*b* so that a snug fit is created when the base and housing meet in pocket 14*e*.

Figure 8:
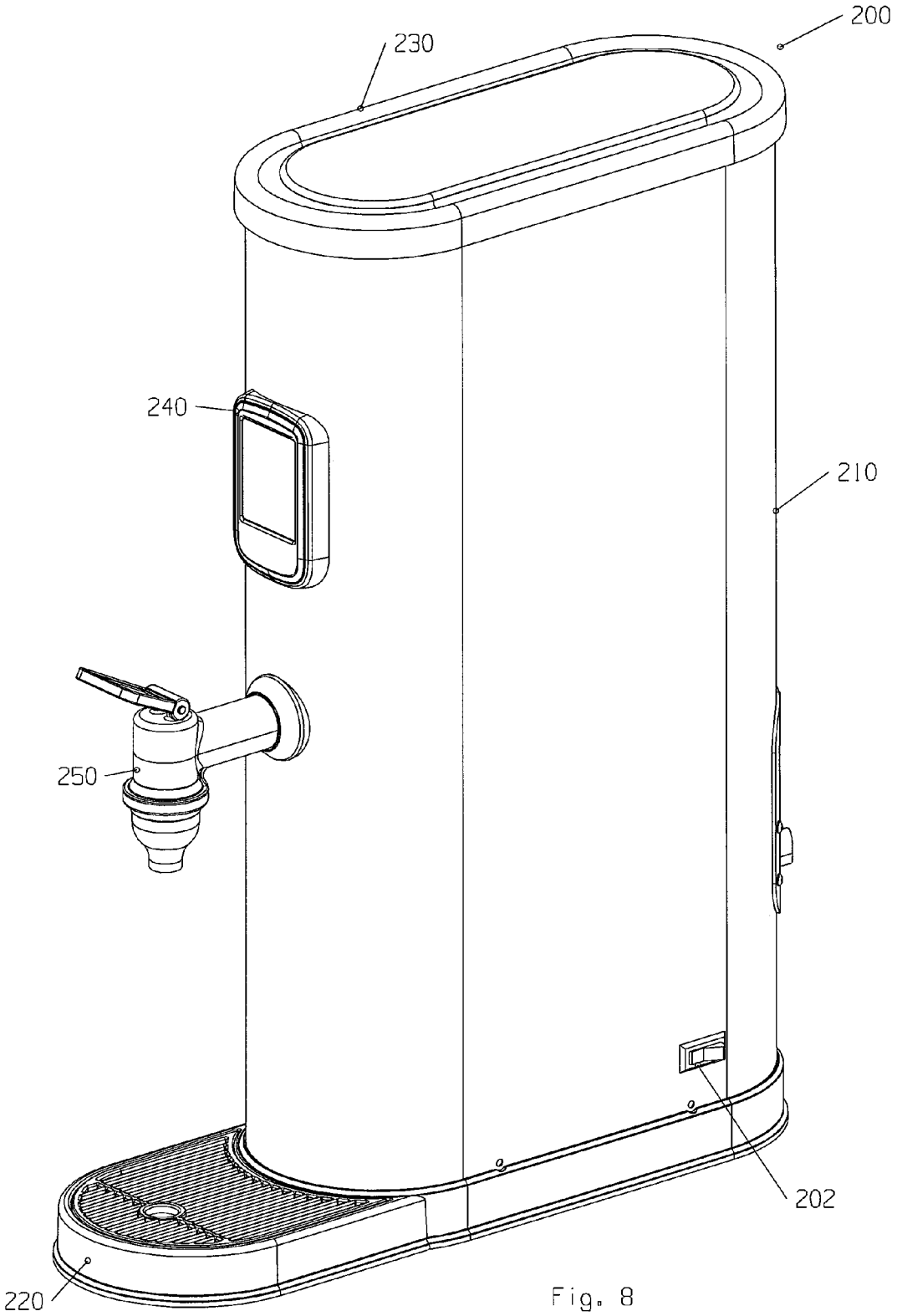
FIG. 8 is a perspective view of another example beverage dispenser.
Figure 8A:
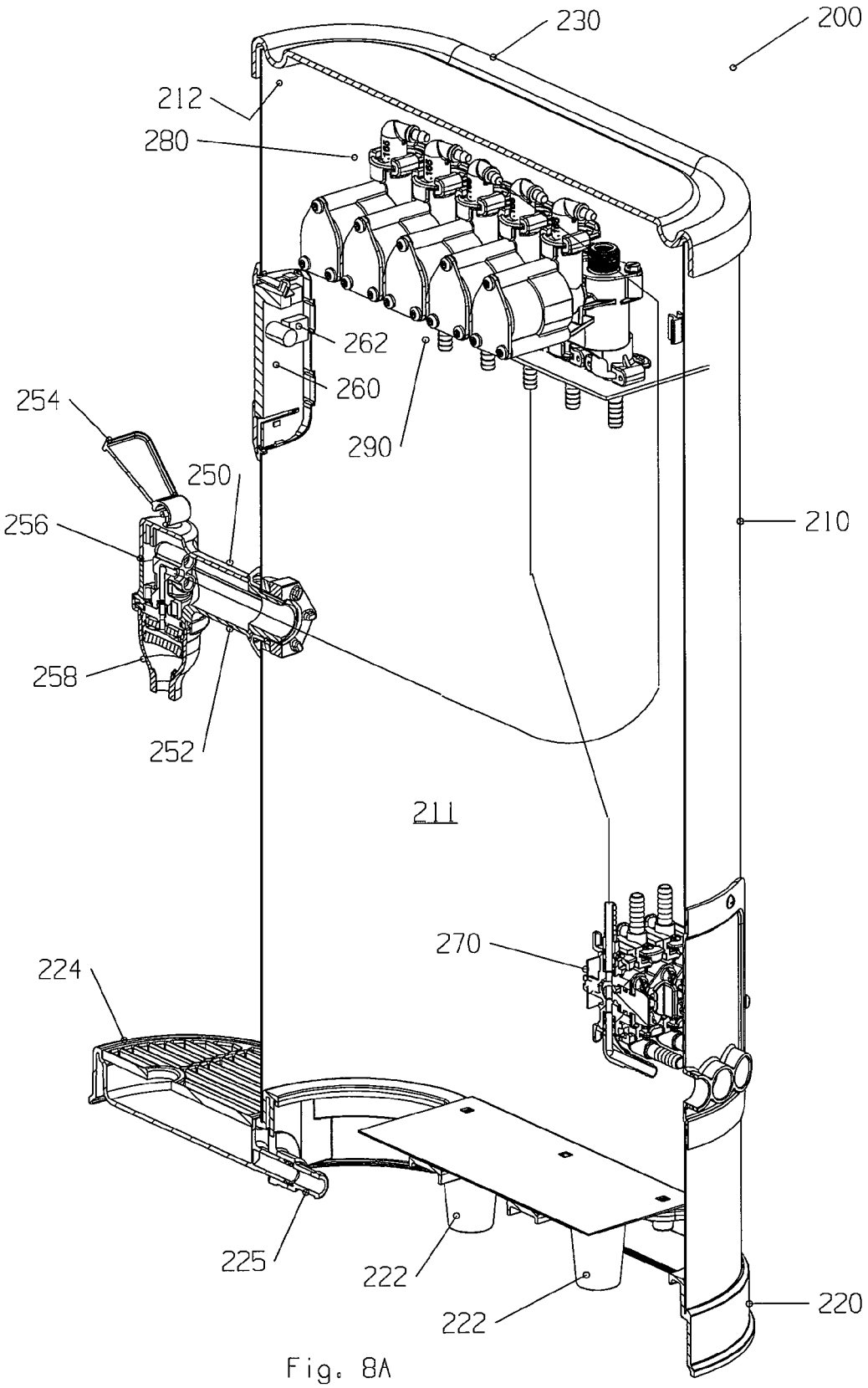
FIG. 8A is a cutaway cross-sectional perspective view showing the interior of the second example beverage dispenser.
Figure 8B:
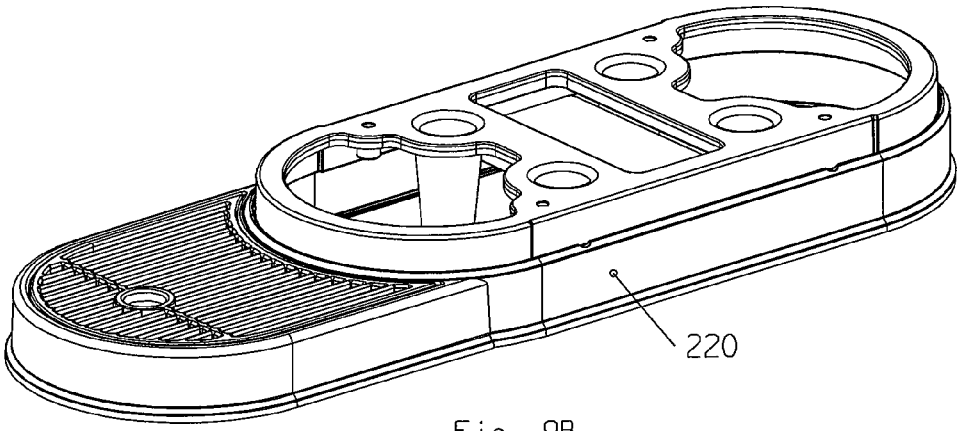
FIG. 8B is an isometric view of the base.
Figure 8C:
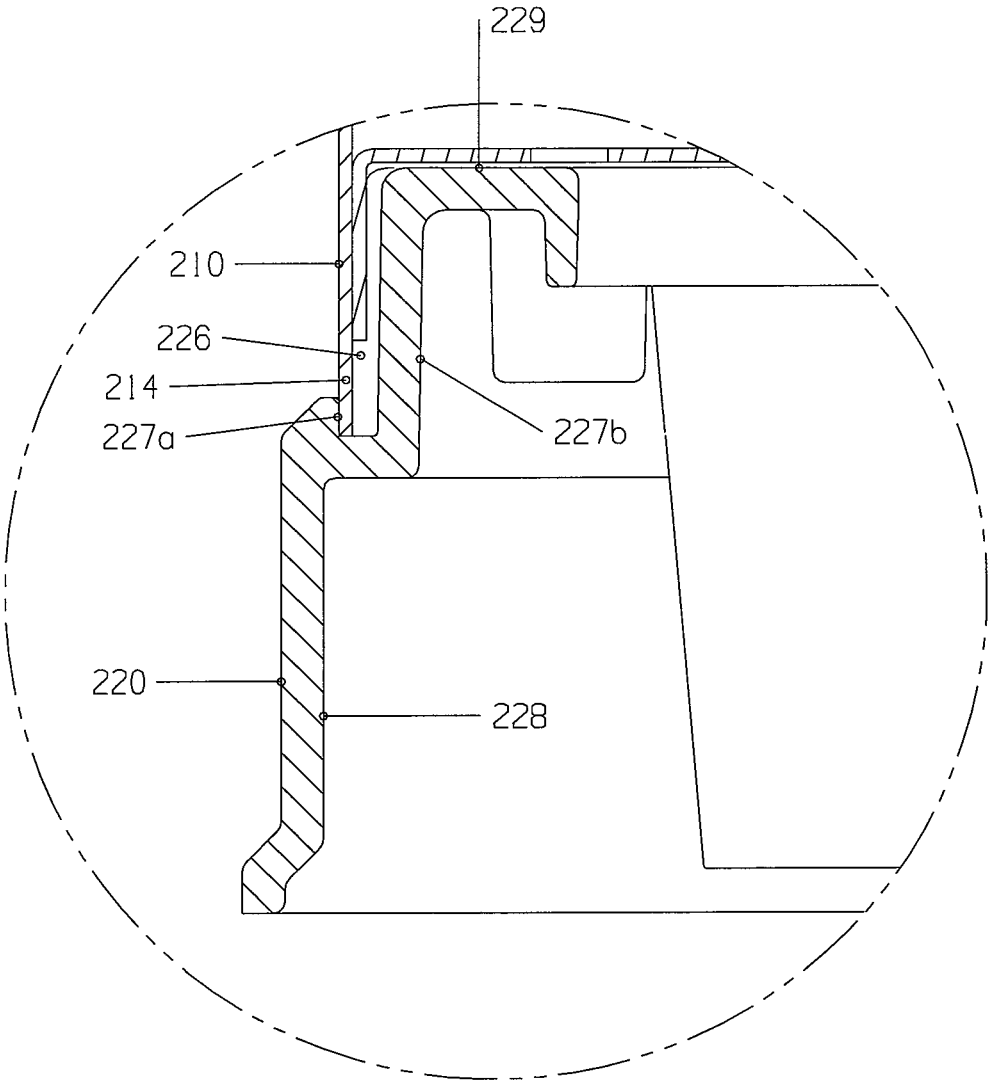
FIG. 8C is a partial cutaway view of the manner in which the lower perimeter of the housing meets the base.

FIGS. 8-8C illustrate another example beverage dispenser 200. Beverage dispenser 200 includes a housing 210, a base 220, and a lid 230, configured to engage a top perimeter 212 of housing 210.

Housing 210 defines an interior 211, in which some of the beverage dispenser components, more specifically set forth below, are located. Turning to the other elements typically exterior to housing 210, the external appearance of beverage dispenser 200 illustrates the use of an electronic control screen or panel 240 operable as set forth herein, combined with, typically, a post-mix valve 250, such as a T-handled post-mix valve having an inlet 252, a handle 254 extending upward from a body 256 and a nozzle 258 extending downward from the body. Beverage dispenser 200 also includes an on/off switch 202.

Beverage dispenser 200 is adapted to engage a multiplicity of flavor concentrates, such as BIB pressurized flavors, through lines. Further, beverage dispenser 200 is adapted to engage a pressurized water supply, such as city water. Flavor lines are typically provided to engage the multiplicity of bag-in-box flavor sources and a water line is provided to engage city water or other source of pressurized water through quick disconnect assembly 270. The lines are coupled to flow control elements 280, which control the flow of fluid to nozzle 258 so that flow controlled water/flavor is provided to nozzle 258 in a specific mix ratio adapted or designed to provide the specific mix of concentrate and water as known in the art. Flow control elements 280 engage dispensing controllers 290. Dispensing controllers 290 may be activated by a sensor located on the front of housing 210 or by manipulation of handle 254 by a user of beverage dispenser 200. The activation of one of the user input devices generates an electronic signal, which is passed to a computer 262. Dispensing controllers may, for example, be solenoids.

Inside housing 210 is an electronic mounting 260 (e.g., a printed circuit board (PCB)). Coupled to printed circuit board is computer 262. Computer 262 typically includes a processor and memory. Control panel 240 is also coupled to electronic mounting 260 and so are dispensing controllers 290. In certain implementations, beverage dispenser 200 may also include a number of other user output devices and user input devices, which may be coupled to electronic mounting 260 and/or computer 262.

Beverage dispenser 200 may receive electrical power to operate the electronics therein (e.g., control panel 240, computer 262, and dispensing controllers 290). In particular implementations, electrical power for beverage dispenser 200 may be provided by converting standard commercial AC power (e.g., 120 V) to DC power (e.g., 24 V). The electrical power may be converted by a power transformer (e.g., a rectifier) that is external to housing 210. Although the internal components of beverage dispenser 200 should not leak, a leak is still possible. Thus, it is safer to deliver DC power inside the beverage dispenser.

Base 220 includes legs 222 and a drip tray 224 that extends laterally relative to housing 210. In certain implementations, legs 222 may receive screws and anchor the base to a support surface (e.g., a counter). Coupled to drip tray 224 is a drain adapter 225 to allow fluid in the drip tray to drain off.

Base 220 is configured with a pocket 226 dimensioned to snugly receive lower perimeter 214 of housing 210 to help prevent the housing from tipping. Prior art housing to base fastening systems have in some instances proved to be flimsy or unstable. Pocket 226 helps alleviate this condition.

Base 220 is seen to have an outer arm 227*a* extending upward and an inner arm 227*b* extending upward, the two forming pocket 226 therebetween. Extending below the pocket is lower leg 228, the removed end of which typically rests on the support surface. A floor or inner lip 229 extends inward from the upper edge of inner arm 227*b*.

In certain modes of operation, a user's manual input on control panel 240 (e.g., on a "push to start" screen carrying a "push to start" screensaver prompt) may initiate a four quadrant, four flavor "pick the product" screen prompt, such as a screen displaying products A/B/C/D, one in each quadrant. Touching one of the four quadrants may send a signal to computer 262, which may, having been awoken with the push to start operation, enter a ready state for receipt of a signal from control panel 240 for prompting one of four flavor selections. After a flavor selection, computer 262 may wait for receipt of a signal from a sensor in the handle for prompting dispensing. Optionally, a third screen may come up instructing the user to pull the handle to activate or, optionally, select a flavor strength prompt may be displayed on the control panel providing a weak, medium or strong beverage selection, initiated by a touch of the screen broken up into, for example, three sections. In any case, sequential manual operation of control panel 240 may prompt the computer for receipt of a signal from an electro-mechanical sensor (e.g., a Reed switch or a Hall effect sensor) engaging handle 254 of post-mix valve 250. The user may then pull the handle as in a normal mechanical dispensing operation and the computer will, in receipt of the signal therefrom, send open signals to the dispensing controllers 290 for the selected flavor and the water and may further provide for a "time to close" signal to the selected dispensing controllers (water and flavor selected).

Thus, four beverage flavors, as well as the water supply, are controlled from an electronic sensor manually engaged with handle 254. In other implementations, a different number of beverage flavors may be controlled (e.g., 3 or 5). The sensor is electronically engaged with computer 262 to open and close dispensing controllers 290 in one of the desired flavor lines and the water line responsive to the operation of handle 254. The appropriate beverage line to open depends on the user selected flavor based on the user's touch or other input on control panel 240, which is conveyed to computer 262.

To stop dispensing a beverage, a user releases handle 254. The sensor in the handle then sends a signal to computer 262, which deactivates dispensing controllers 290. In certain implementations, the dispensing controller for the flavor may be deactivated before (e.g., 20-30 ms sooner) than the dispensing controller for the water. This may allow a rinsing of nozzle 258.

In some implementations, computer 262 may be pre-programmed for a "time to close" signal, upon opening of the dispensing controllers or may be programmed to be responsive to close the dispensing controllers through the closing of the handle actuated sensor. That is to say, the period of time that the dispensing controllers (water and flavor selected) are open may be a function of the manipulation of the handle initiated by the user's operation of the handle, or it may be preprogrammed, through, for example, user selected strong/medium/weak, for a preselected period of time (known container volume). In the latter case, the activation of the handle merely prompts computer 262 to initiate the preselected time for maintaining the dispensing controllers in an open condition, with the subsequent flow of the predetermined beverage quantity to the nozzle.

Control panel 240 may be a touch membrane, a capacitive touchscreen, a resistive touchscreen, or any other appropriate touch-sensitive device. Control panel 240 may display text and/or graphics associated with various parts of the touchscreen, which correspond to different beverage flavors (e.g., regular, sweetened, decaffeinated, etc.).

In certain implementations, another user input device may also be included to activate dispensing of a beverage. The user input device could, for example, be a capacitive switch or a manual switch. This user input device could operate in congruence with handle 254.

Figure 9A:
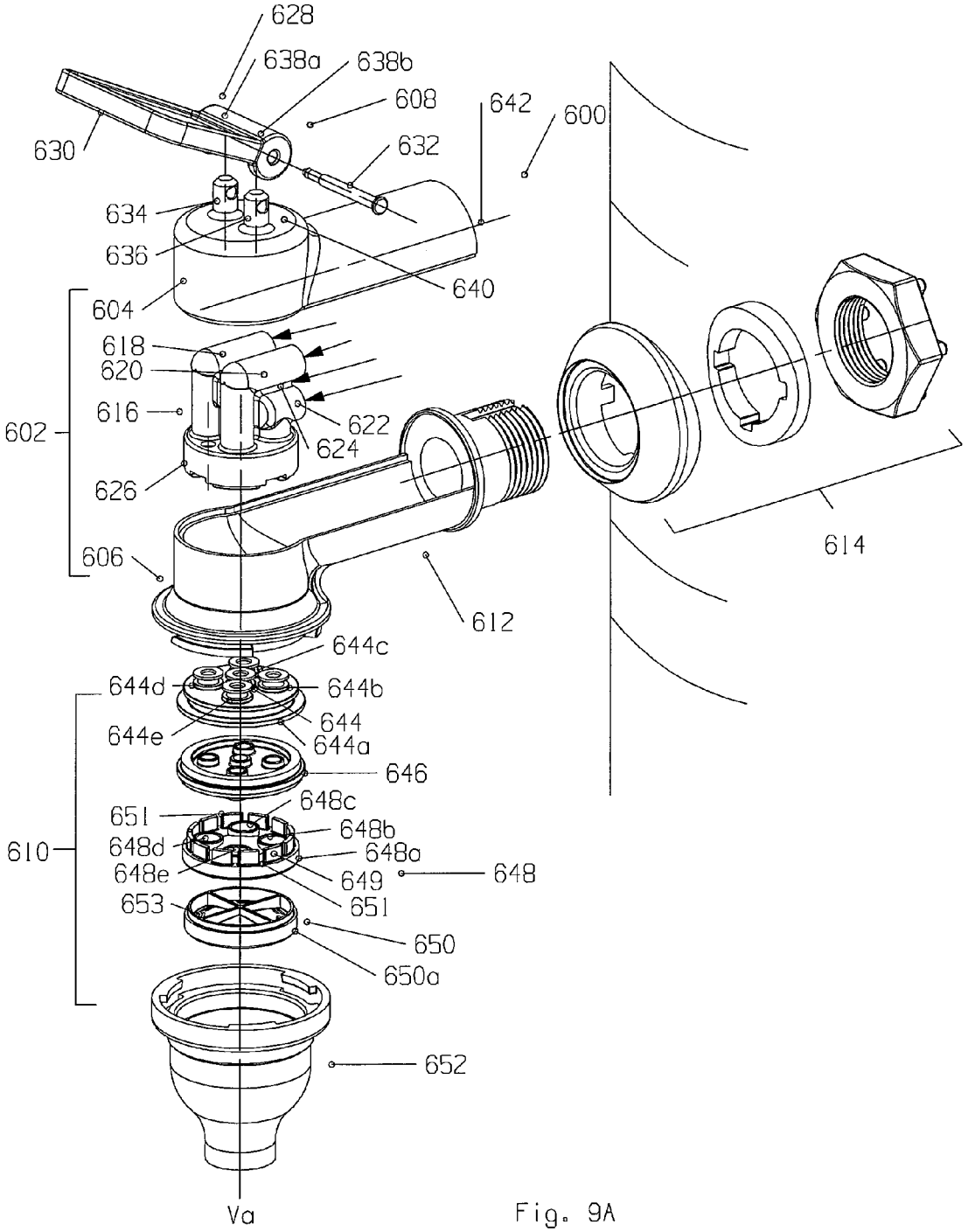
FIGS. 9A-B are an exploded views of an example dispensing valve.
Figure 9B:
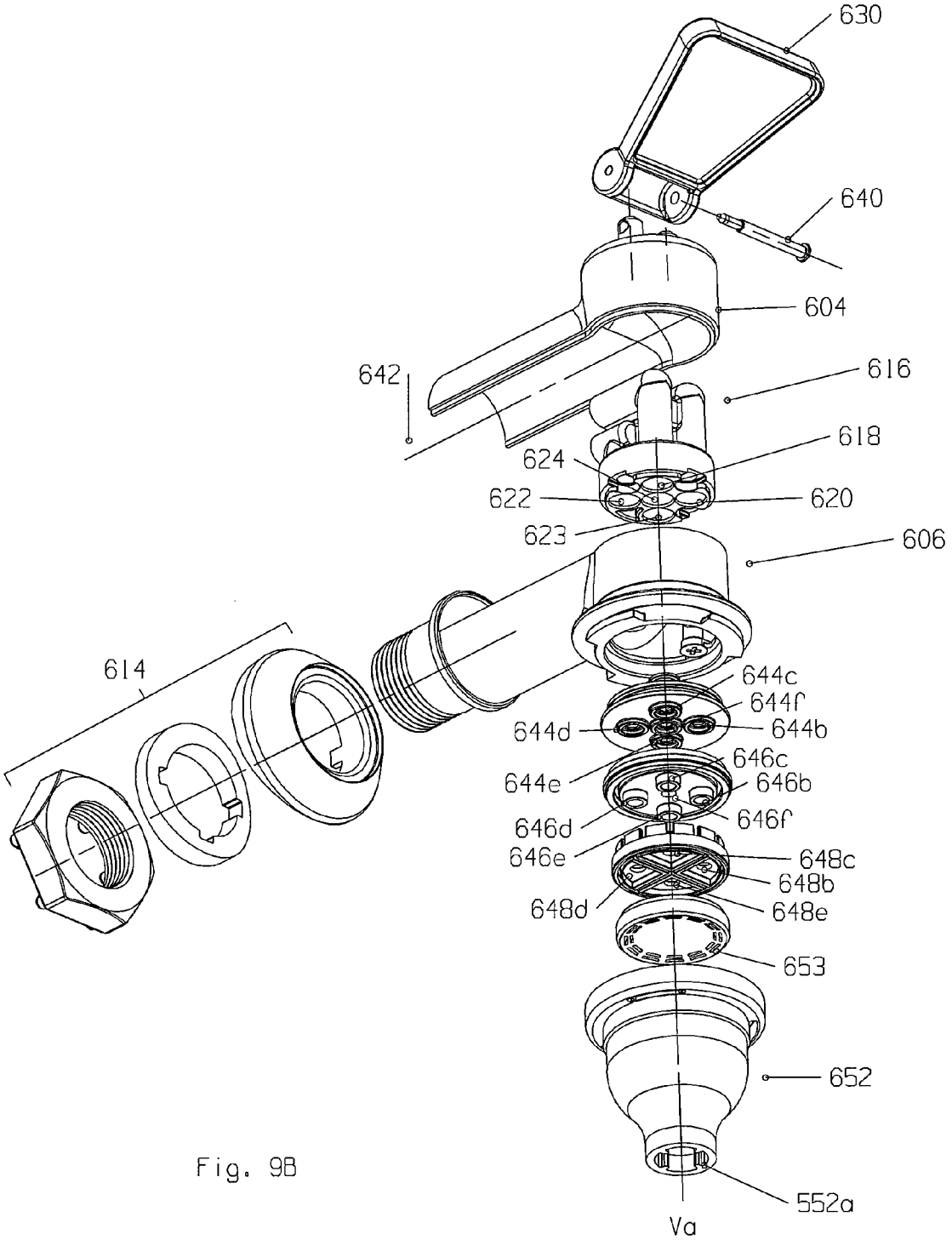

FIGS. 9A-9B illustrate perspective exploded views of an example four flavor valve 600 for engaging an urn or other suitable housing. Valve 600 includes a housing 602, which may include an upper portion 604 and a lower portion 606, the two portions which may be engaged to one another by sonic welding or the like and may contain elements therein as set forth more further below.

A handle 608, which may have a base 628 as in the cylindrical base illustrated and, extending generally upward from the base, a yoke 630, such as is known in the art. The base of handle 602 may have a hole or holes therethrough with which to engage a pin 632. Pin 632 may be engaged with upstanding mounting bosses 634/636 to pivotally mount the handle to the top of the valve body. Elements of the handle, such as base 628, may have hall effect sensors 638*a*/638*b* engaged therewith and rotatable upon movement of the handle, rotatable, that is, with respect to the handle body. Valve housing 602 may include a hall effect sensor 640, which is stationary with respect to the pivoting handle. A magnetic elements of the sensor may generate a voltage to be carried by wire or wires 642 to the electronic elements of the urn, so as to signal movements of the handle and initiate operation of the dispensing elements.

A nozzle assembly 610 is seen to engage the housing 602. A lateral extension 612 may extend substantially perpendicular to the vertical axis Va of handle housing 602, so as to engage an urn housing through connector elements 614 as is known in the art.

Housing 602 is configured to contain a receiver 616, which functionally will receive four flavors in concentrate legs 618/620/622/623. A water leg 624 is included in the receiver and is centrally mounted as best seen in FIG. 9B, with the concentrate legs spaced about the centrally located water leg 624. Moreover, it is seen that the receiver will receive, as typically in flexible or hard lines, four concentrate flavors and water, and will direct them from a generally horizontally trending path to a vertically trending path directing the channels for pressurized concentrates as well as the pressurized water vertically downward to the nozzle assembly 610.

A general overview of the function of Applicants' four flavor valve 600 will show that the elements downstream of receiver 616 will maintain the five fluids segregated from one another until, first, the water is circumferentially and evenly spread about the inner walls of nozzle housing 652 and, second, a one of the four concentrates will be directed outward against the inner walls of nozzle housing 652 by spray head 650, more specifically, by slats 653 thereof.

U.S. Pat. No. 8,109,413 is incorporated by reference and discloses a post-mix valve with a nozzle assembly, which achieves the segregated functions of the present nozzle assembly 610, and achieves mixing of fluids only on the nozzle housing 652. That is to say, upstream of nozzle housing 652, there is complete segregation of the four concentrate flavors, one from the other, and complete segregation of the water from the four concentrates, mixing occurring only on the inner walls of nozzle housing 652. Thus, cleaning of the parts of the valve or of the dispensing machine where the flavors mix is achieved by simply removing the nozzle from the lower perimeter of the housing and washing it. Moreover, as is set forth in the '413 patent and set forth in the valve herein, the concentrate strikes the inner walls of the nozzle housing below the water. Moreover, as spray head 650 includes sections 650*b*/650*c*/650*d*/650*e*, each section dedicated to a single concentrate and each section having slats 653 directing the flavor to a separate quadrant of the inner walls of the nozzle housing, there is less of a chance of mixing of the concentrate flavors or overlapping of the concentrate flavors when they are deposited on the inner walls of the nozzle housing.

The underside of receiver 616 has channels 618/620/622/623/624 representing the concentrate and water legs with, which receiver nay engage the interior housing in ways known in the art. Downstream of receiver 161 is upper cap 644 with the rim 644*a* engaged to fluidly couple or otherwise engage housing 606, such that concentrate channels 644*b*/644*c*/644*d*/644*e* engage and fluidly couple to channels 618/620/622/623 and that water channel 644*f* engages channel 624. Lower cap 646 may also include channels 646*b*/646*c*/646*d*/646*e*/646*f* in the same pattern to fluidly couple with the channels of upper plate cap.

Turning to FIGS. 9A and 9*b*, it is seen that a diverter plate 648 is provided with a multiplicity of circumferential walls 649 defining a multiplicity of circumferential channels 651. Channels of lower cap 646, namely, 646*b*/646*c*/646*d*/646*e* carrying concentrate fluidly couple with channels in diverter plate, namely, channels 648*b*/648*c*/648*d*/648*e*. However, the channel of lower plate 646*f* carrying water will deposit the water on a floor of diverter plate 648 and, being pressurized, the water will be forced out between the circumferential walls 649, namely, in circumferential channels 651, and directed against the inner walls of the nozzle housing. Spray head 650 is seen to have walls defining rim 650*a* and walls defining quadrant sections 650*b*/650*c*/650*d*/650*e*. Moreover, it is seen that the underside of diverter plate 648 has walls that will engage the walls of the spray head defining the quadrant, so as to maintain the four concentrates emerging from concentrate channels 648*b*/648*c*/648*d*/648*e* (see FIG. 9B). Since the fluid couplings all the way from the dispensing controllers downstream to the head are typically substantially fluid tight, the dispensing controllers triggered to allow the concentrate flow will force the concentrate out the slats associated with the particular concentrate channel and the slats will direct the concentrate to the inner walls of the nozzle, below the area in which the water is cascading (by virtue of the action of the circumferential channel 651).

Because the water is dispensed into the nozzle above the beverage concentrate, the water should be the last fluid to run through the nozzle when a beverage is dispensed. Thus, the nozzle may be partially rinsed due to this injection.

Figure 10:
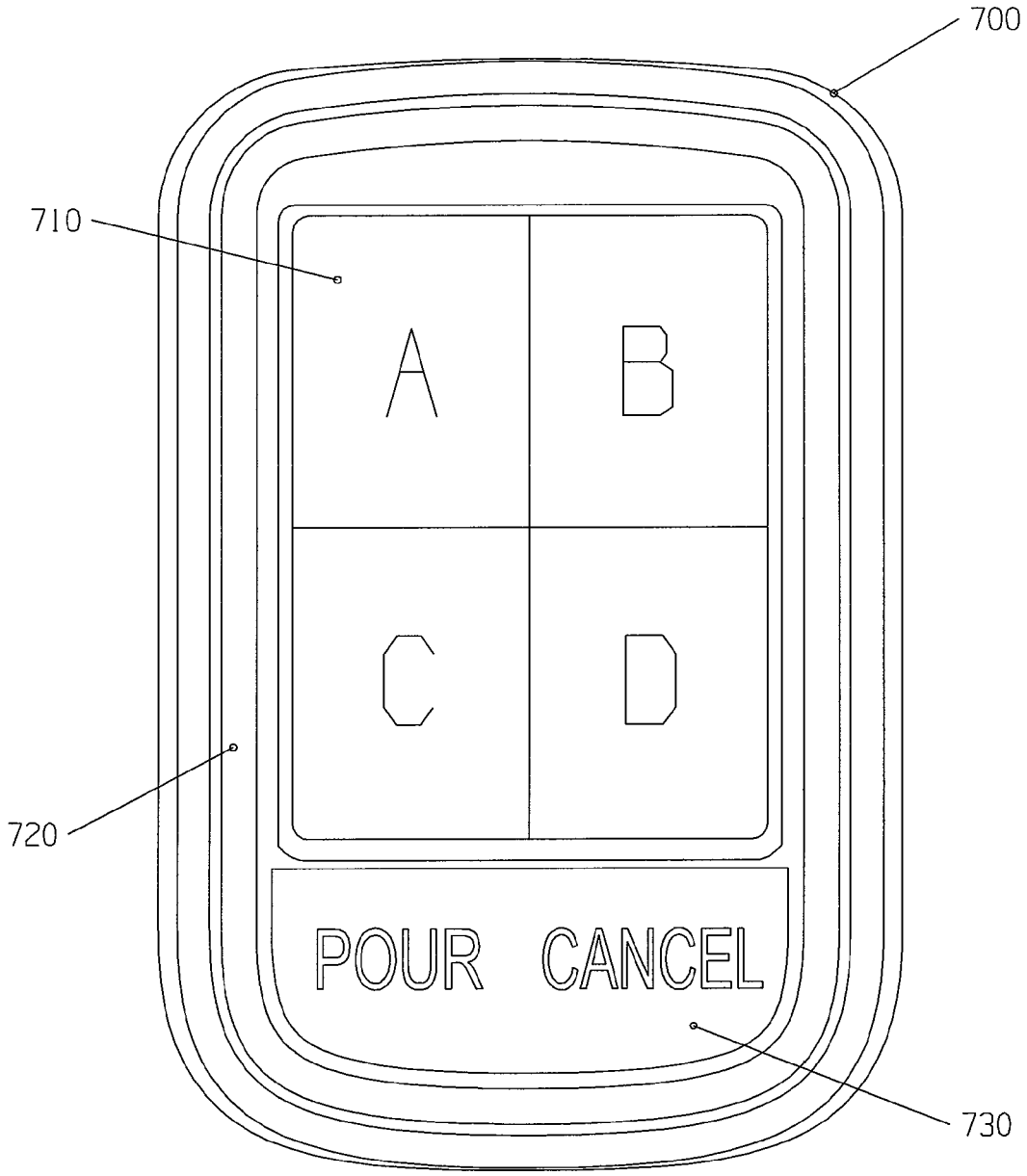
FIG. 10 is a front view of an example input panel.

FIG. 10 illustrates an example control panel 700 for a beverage dispenser. Control panel 700 includes a touchscreen 710 and a user input device 730.

Touchscreen 710 is illustrated as being divided into four quadrants, which may correspond to different beverage flavors. However, touchscreen 710 may be divided into any number of portions and display most any text and/or graphics. For example, touchscreen 710 may divided into divided into three sections if three flavors are to be dispensed. In particular implementations, touchscreen 710 is a capacitive touchscreen.

Touchscreen 710 is mounted in a bezel 720, which also includes user input device 730. As illustrated, user input device 730 includes two portions—one to activate pouring and one to cancel functions (e.g., pouring). In particular implementations, user input device 730 may be a capacitive switch.

Figure 11:
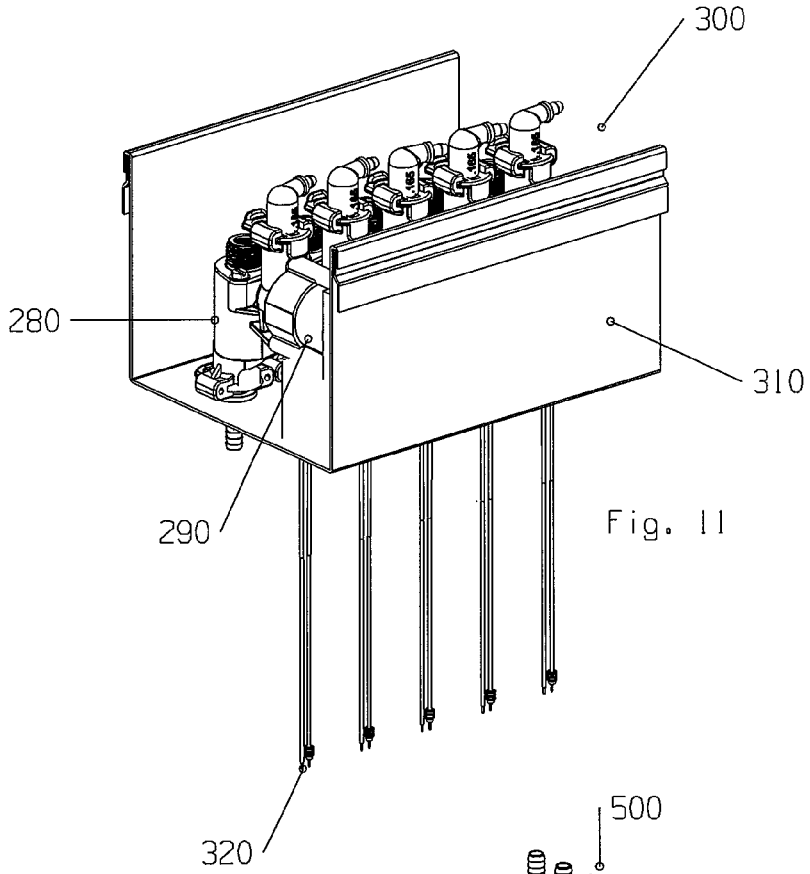
FIG. 11 is a perspective view of an example flow control assembly.
Figure 11A:
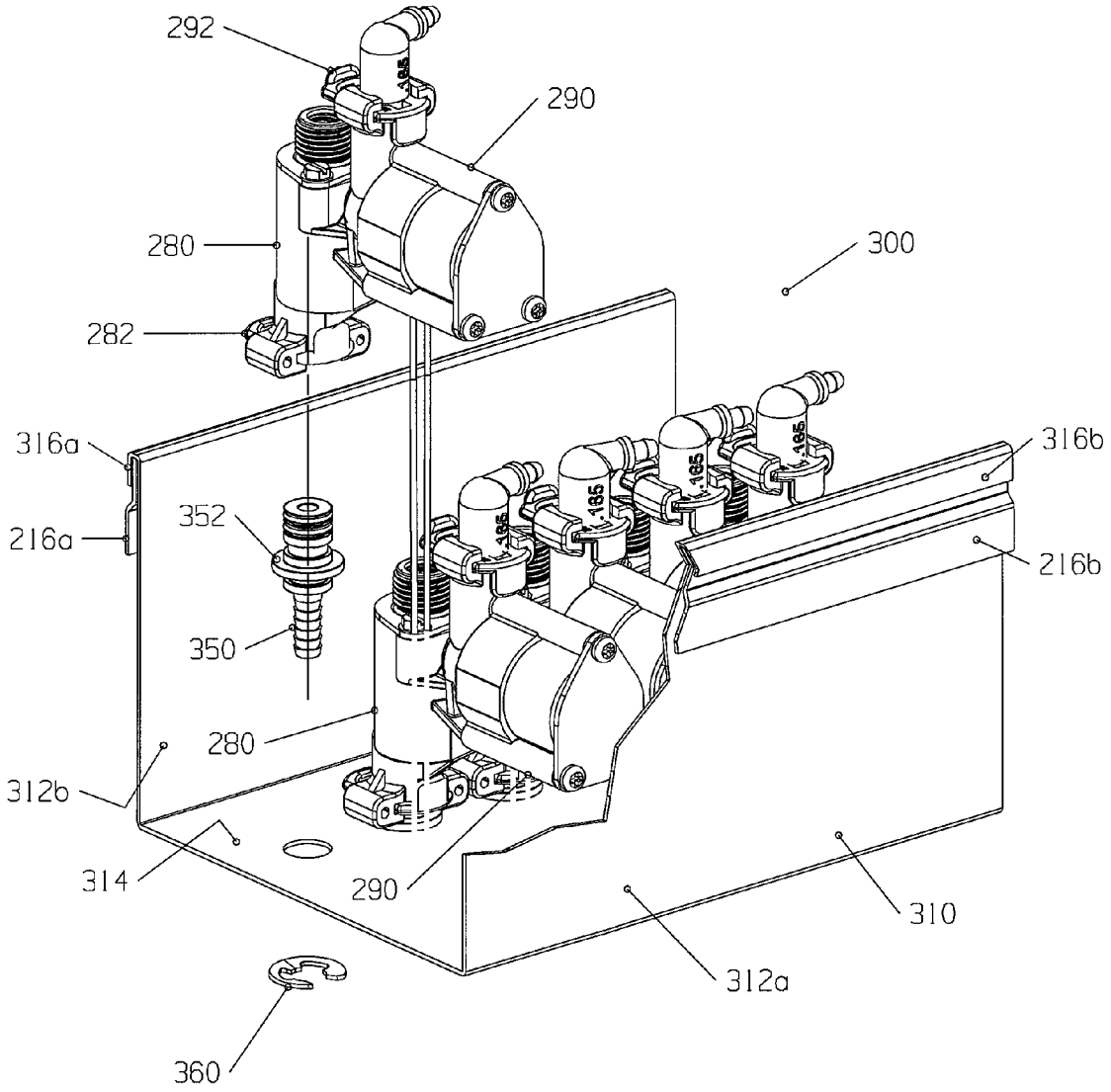
FIG. 11A is a cut-away perspective view of the example flow control assembly.
Figure 11B:
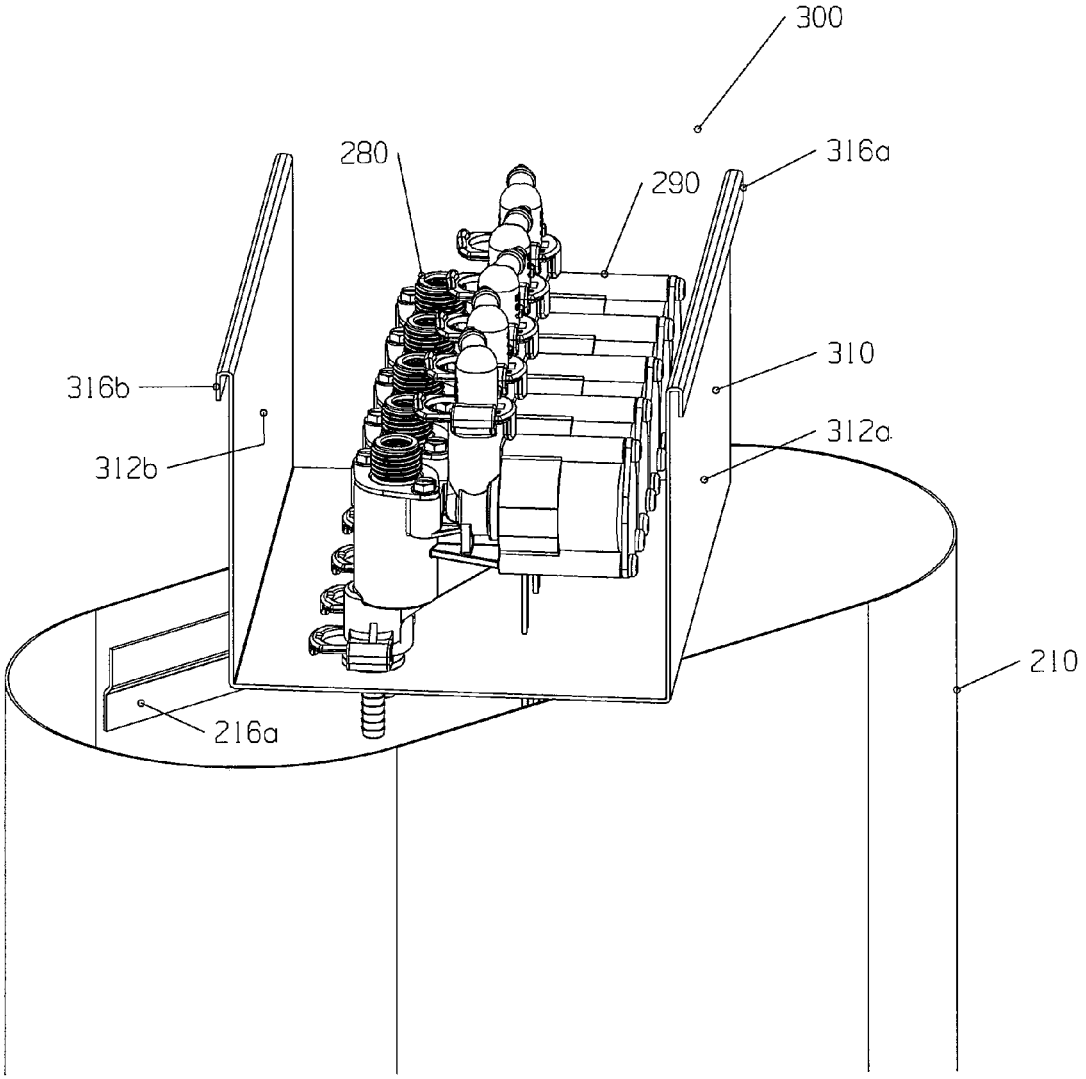
FIG. 11B is a perspective view of the example flow control assembly interacting with a housing.

FIGS. 11-11B illustrate an example flow control assembly 300. As illustrated, flow control assembly 300 is adapted to hold a number of flow control elements 280 and dispensing controllers 290.

Flow control assembly 300 includes a housing 310. Housing 310 is shown to have a general U-shape, with side walls 312 and floor 314, inside which flow control elements 280 and dispensing controllers 290 reside. However, housing 310 may have any other appropriate shape in other implementations.

At one end of each wall 312 is a lip 316. In the illustrated implementation, lips 316 are formed up turning the top portion of the wall out. Thus, lips 316 are part of wall 312. In other implementations, lips 316 may be attached to walls 312. Lips 316 are adapted to engage rails 216 located on the inside of housing 210, as best seen in FIG. 11A. Thus, housing 310, along with lips 316 may be narrow enough to fit inside housing 210.

As seen in FIG. 11B, rails 216 may be located near to top of housing 210. Thus, flow control assembly 300 may be located near the top of housing for easy servicing. As shown in FIG. 11 B, housing 310 may be long enough so that it can sit on the top of housing 210, which may assist in easy servicing. The lines in housing 210 may have excess length to allow for the raising and lowering of flow control assembly 300. If housing 310 cannot sit on top of housing 210, either long lines would have to be connected to flow control elements 280 or the flow control elements would have to be disconnected from their lines to service flow control assembly 300.

Flow control elements 280 are mounted to housing 310 by a connector 350, which is captured through housing 310 by clip 360. Connector 350 includes a bowed O-ring 352, which is captured on the other side of housing 310 from clip 360. When a flow control element 280 is engaged with a connector 350, a slidable clip 282 may be moved to secure the flow control element to the connector. Dispensing controllers 290 are integrally secured to flow control elements 280 and, thus, are supported by the engagement of the flow control elements with the slidable clips. In certain implementations, structure (e.g., foam) may be placed under dispensing controllers 290 to assist securing them.

In other implementations, dispensing controllers 290 do not have to be secured to flow control elements 280 in a unitized manner. For example, they may be separated by and coupled by a line.

Dispensing elements 290 are shown engaging outlet elbows. The elbows may be secured to dispensing elements 290 with slidable clips 292. Thus, a flow control element 280/dispensing element 290 combination may be toolessly, lockingly engaged to fluid flow components in housing 210.

Flow control elements 280 and dispensing controllers 290 are typically adjustable in ways known in the art. For example, flow control elements 280 include a screw-type mechanical adjuster for adjusting the flow therethrough. And when dispensing controllers 290 are solenoids, they may be adjusted on/off and electronically actuated in ways known in the art.

As illustrated in FIG. 11, wires 320 extend from each dispensing controller 290. These wires may be plugged into an electronic mounting (e.g., a printed circuit board (PCB)) so that a computer can control the dispensing controllers. The dispensing controllers 290 may also receive power through wires 290. FIG. 11B illustrates wires 320 extending through housing 310. However, this is not necessary in particular implementations (e.g., the wires may run through the U-shaped portion of housing 310).

Figure 12:
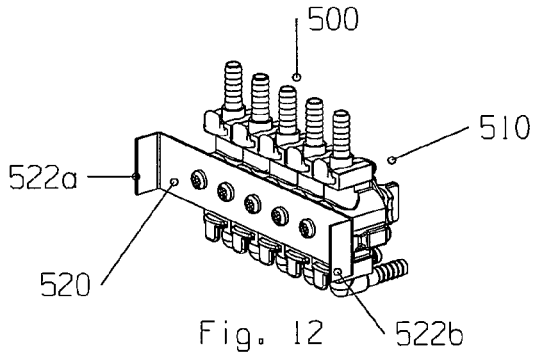
FIG. 12 is a perspective view of an example quick disconnect assembly.
Figure 12A:
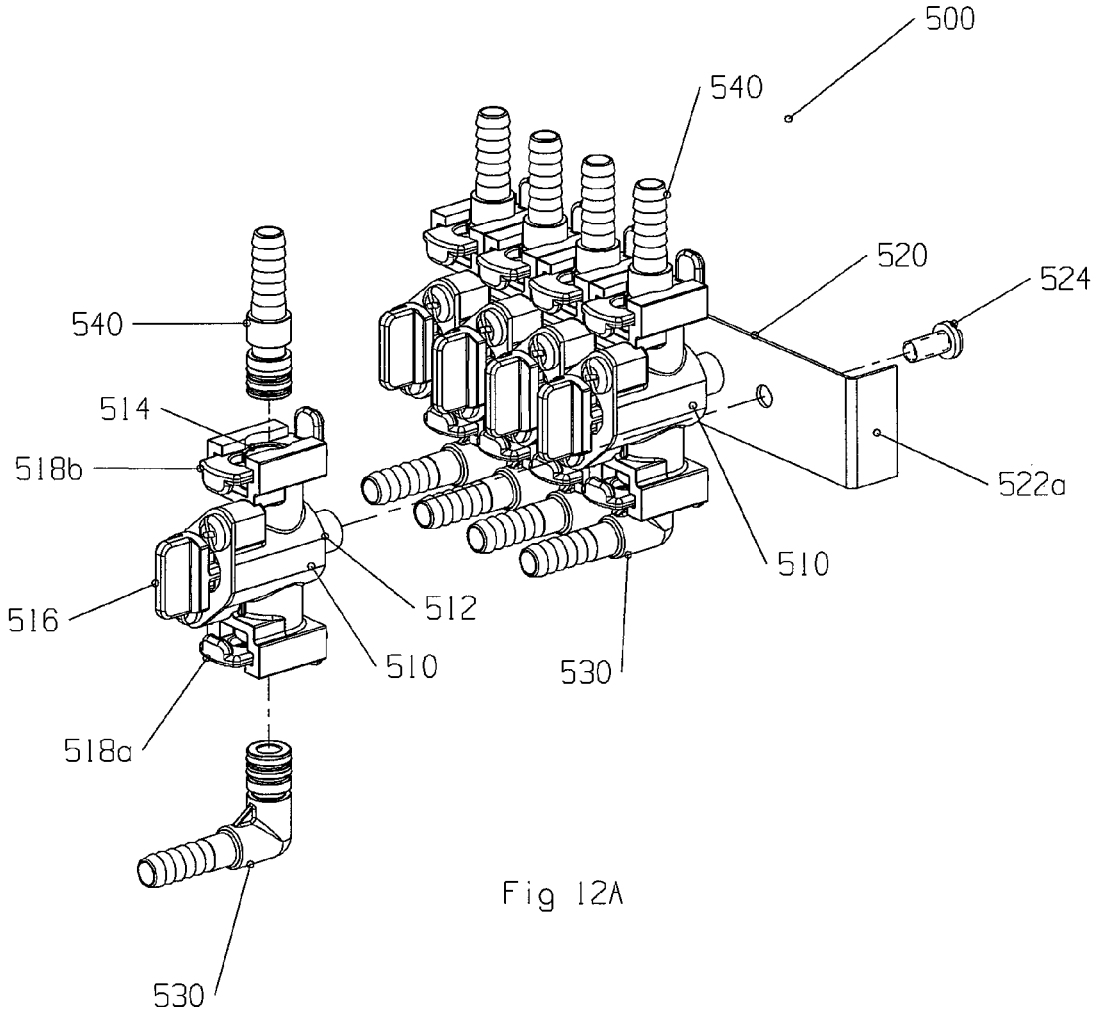
FIG. 12A is an exploded view of the example quick disconnect assembly.

FIGS. 12-12A illustrate an example quick disconnect assembly 500. Quick disconnect assembly 500 functions to provide a rigid, aligned unitized structure for quick receipt of incoming fluid lines from a pressurized fluid source external to a beverage dispenser and connecting those incoming lines in quick disconnect fashion through quick connect elements 510.

Quick connect elements 510 are similarly constructed, and one is seen in detail in FIG. 12A. Quick connect elements 510 include a body 512 having a female inlet port below (not viewable) and an female outlet port 514 on the top.

Quick connect elements 510 also include a valve (not viewable) in body 512 and a valve actuation mechanism 516. The valve may, for example, be a butterfly valve or a ball valve, and a user may actuate the valve by twisting valve actuation mechanism 516.

Quick connect elements 510 further include clips 518. Clip 518*a* is located on the bottom, next to the female inlet port, and clip 518*b* is located on the top next to the female outlet port 514. Clips 518 are configured to slide back and forth to engage connectors. As illustrated, clip 518*a* engages an elbow connector 530, and clip 518*b* engages a straight connector 540. The connectors have locking slots on the portions which are inserted into the ports so that clips 518 may engage the connectors. Although connectors 530 are shown as being 90 degree elbows they may have other shapes (e.g., straight of 45 degrees) depending on application. Connectors 540 may also have varying shape.

Body 512 is adapted to engage fasteners 524 extending through a bracket 520, which functions to engage quick connect elements 510 and hold them in an aligned manner. Bracket 520 receives fasteners 524 on one side thereof and quick connect elements 510 on the other side thereof. Bracket 520 is seen to have wings 522 on either end thereof dimensioned to be welded, screwed, or otherwise fastened to the inside of a housing.

Quick connect assembly 500 functions to engage incoming fluid lines and couple those fluid lines to internal fluid lines carrying fluid to the individual flow control elements as set forth hereinabove. Moreover, it will be seen that quick connect elements can toolessly engage the incoming fluid lines either from the rear, using an elbow connector, or incoming fluid lines coming up from the base below using a straight connector.

In certain implementations, a quick connect assembly is not used. For example, quick connect elements 510 may be loose inside a housing. Moreover, some implementations may not have quick connect elements.

Figure 13:
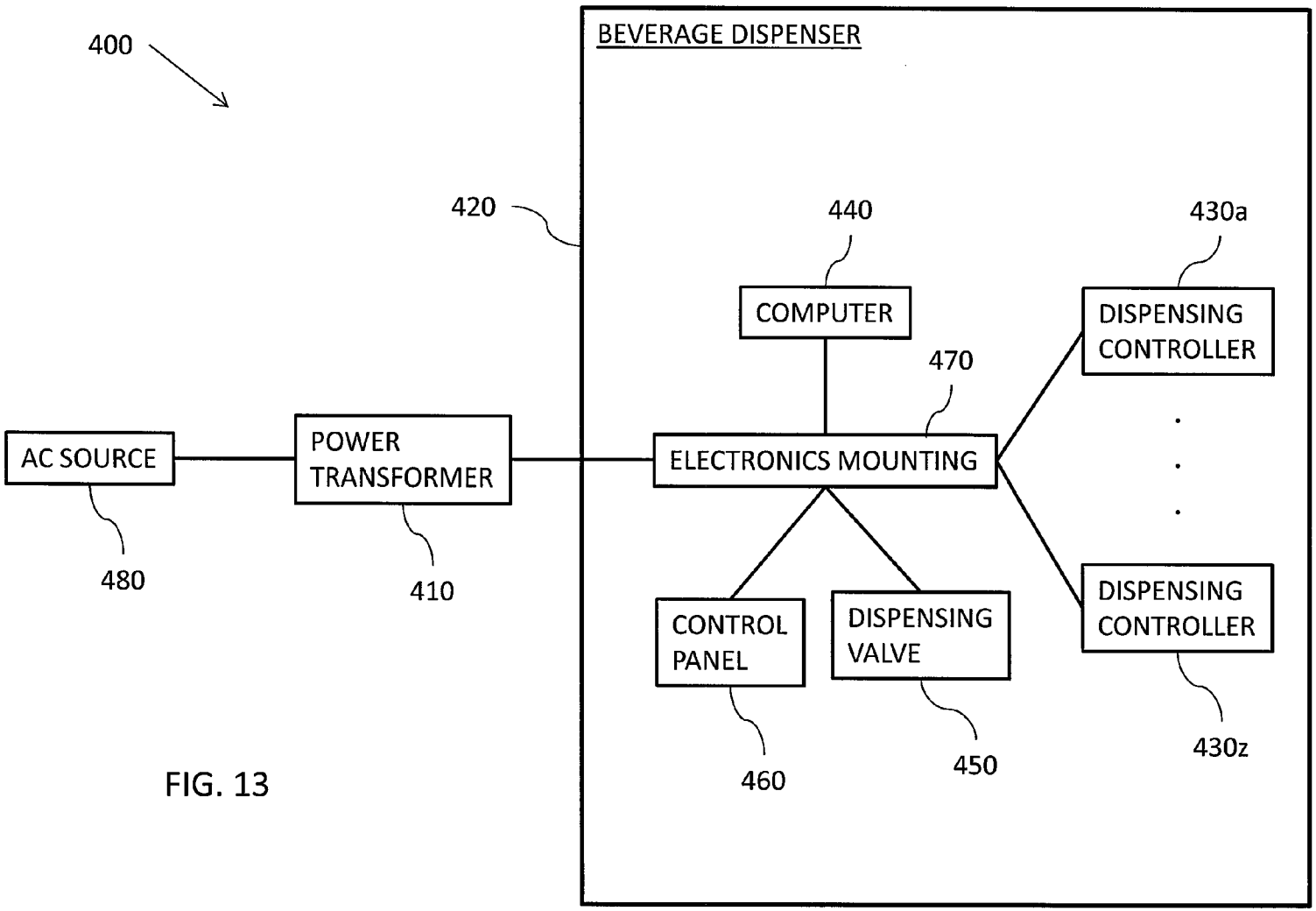
FIG. 13 is a block diagram illustrating example power distribution for a multi-flavored beverage dispenser system.

FIG. 13 illustrates example power distribution for a multi-flavored beverage dispenser system 400. Beverage dispensing system 400 includes a power transformer 410 and a beverage dispenser 420.

Power transformer 410 is adapted to received alternating current (AC) power (e.g., 120 Vat 60 Hz) from an AC source 480, which may, for example, be an electrical outlet or a circuit breaker. Power transformer 410 is further adapted to convert the AC power into direct current (DC) power (e.g., 24 V). To perform the conversion, power transformer 410 may include a rectifier, which may, for example, be a group of diodes arranged in a bridge configuration. Because power transformer 410 is placed outside beverage dispenser 420, only DC power is conveyed to beverage dispenser 420.

Beverage dispenser 420 includes dispensing controllers 430, a computer 440, a dispensing valve 450, and a control panel 460. Dispensing controllers 430 are responsible for allowing fluids (e.g., beverage concentrate and/or water) to flow to dispensing valve 450, which is responsible for mixing the fluids and providing them to a consumer.

Dispensing controllers are controlled by computer 440. As discussed previously, computer 440 may receive inputs from control panel 460, which may include a touchscreen. Based on the input from control panel 460, computer 440 may determine which of dispensing controllers 430 to activate based on this input and activate dispensing controllers 430 based on a signal from dispensing valve 450.

The electronic components in beverage dispenser 420 are coupled to an electronics mounting 470 (e.g., a PCB). Electronics mounting 470 is responsible for receiving the DC power signal from power transformer 410 and conveying the signal to the electronic components so that they may receive power.

In certain implementations, beverage dispenser 420 may include other electronic components. For example, beverage dispenser may include a touch-sensitive sensor (e.g., a mechanical switch or a capacitive switch).

Figure 14:
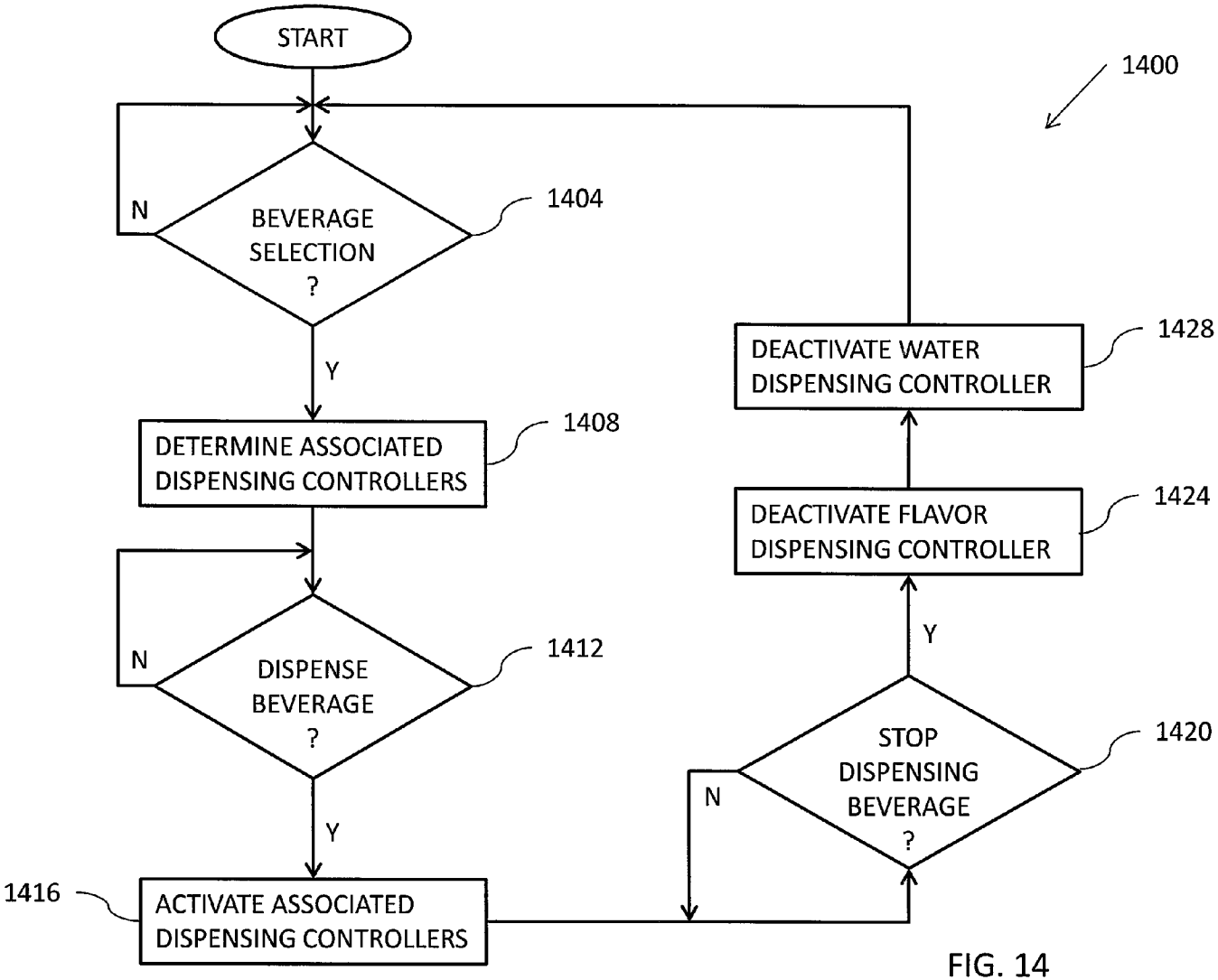
FIG. 14 illustrates an example process for dispensing beverages from a multi-flavored beverage dispenser.

FIG. 14 illustrates an example process 1400 for dispensing beverages from a multi-flavored beverage dispenser. Process 1400 may, for example, be implemented by beverage dispenser 10 or beverage dispenser 200.

Process 1400 calls for determining whether a beverage has been selected (operation 1404). Determining whether a beverage has been selected may, for example, be accomplished by determining whether a signal from a user input device (e.g., a touchscreen) has been received. A beverage may, for example, be selected from a group (e.g. two or more) beverages. If a beverage has not been selected, process 1400 calls for continuing to wait for a beverage to be selected.

Once a beverage is selected, process 1400 calls for determining dispensing controllers (e.g., solenoids) associated with the selected beverage (operation 1408). In particular implementations, for example, a different dispensing controller may be associated with each beverage flavor.

Process 1400 also calls for determining whether a command to dispense a beverage has been received (operation 1412). The command may take the form of an electrical signal that is generated when a handle on a dispensing valve is manipulated, a portion of a touchscreen is touched, and/or a button is manipulated. If a command to dispense a beverage has not been received, process 1400 calls for continuing to wait to receive a beverage dispensing command.

Once a beverage dispensing command has been received, process 1400 calls for activating the dispensing controllers associated with the beverage selection (operation 1416). Because the associated beverage components are under pressure, the beverage should start being dispensed.

Process 1400 also calls for determining whether to stop dispensing the beverage (operation 1420). Determining whether to stop dispensing the beverage may, for example, be accomplished by determining whether a time for dispensing the beverage has expired or whether a command to stop dispensing the beverage has been received. A command may take the form of an electrical signal that is generated when a handle on a dispensing valve is manipulated, a portion of a touchscreen is touched, and/or a button is manipulated. If the beverage should not stop being dispensed, process 1400 calls for waiting for until the beverage should stop being dispensed.

Once the beverage should stop being dispensed, process 1400 calls for deactivating the dispensing controller for the flavor (operation 1424). Process 1400 also calls for deactivating the dispensing controller for the water (operation 1428). In some implementations, the dispensing controller for the flavor may be deactivated a short period of time (e.g., 20-30 ms) before the dispensing controller for the water. This will allow the water to rinse the dispensing valve so that subsequent beverages do not contain substantial components (e.g., sugar) from the previously dispensed beverage.

Process 1400 then calls for waiting for another beverage selection. Process 1400 may be repeated a large number of times and is generally stopped when power is lost (e.g., due to the associated beverage dispenser being turned off).

Although FIG. 14 illustrates one process for dispensing beverages from a multi-flavor beverage dispenser, other processes may include fewer, additional, and/or a different arrangement of operations. For example, a process may include determining whether a beverage is to be dispensed. This may, for example, be accomplished by receiving a signal that a user has interacted with a touchscreen. In particular implementations, for example, a touchscreen may display a screen (e.g., a start screen or an advertisement) that must be touched before entering the beverage selection mode. This may assist in preventing a beverage from being inadvertently dispensed. As another example, a process may determine the associated dispensing controllers after receiving the command to dispense the beverage. As an additional example, a process may return to the beverage selection operation or an initiation operation (e.g., a start screen) if the beverage dispensing command is not received within a given period of time (e.g., 2 minutes). Moreover, one or more operations may be performed in a contemporaneous or simultaneous manner.

The invention has been described with reference to a specific implementations, and a variety of others have been mentioned or suggested. However, various modifications (e.g., additions, deletions, substitutions, and transformations) of the disclosed implementations will become apparent to those skilled in the art upon reference to the description. It is therefore contemplated that the appended claims will cover such modifications, alternatives, and equivalents that fall within the true spirit and scope of the invention.

The invention claimed is:

1. A beverage dispenser for engaging an external source of multiple pressurized flavor concentrates and pressurized water, the beverage dispenser comprising:

a housing having a lower perimeter and an upper perimeter;

a lid configured to engage the upper perimeter;

a base configured to engage the lower perimeter;

a post-mix valve coupled to the housing and extending therefrom, the valve comprising a body, a nozzle for dispensing a beverage, a handle operating member extending upward from the body, and a sensor activated by movement of the handle operating member, the post-mix valve configured to separately receive a flavor concentrate and water and mix the two fluids in the nozzle before dispensing;

a flow control assembly inside the housing, the flow control assembly comprising a multiplicity of paired mechanically adjustable flow control elements and dispensing controllers, the dispensing controllers fluidly coupled to the post-mix valve;

a touch-sensitive control panel mounted to the outside of the housing; and a computer for controlling the dispensing controllers of the flow control assembly responsive to user touches of the control panel and user movement of the handle operating member to deliver a flavor concentrate and water from the dispensing controllers to the post-mix valve.

2. The beverage dispenser of claim 1, wherein the base comprises a pocket configured to engage the lower perimeter of the housing so as to hold at least a portion of the lower perimeter in the pocket.

3. The beverage dispenser of claim 1, further comprising a user input device coupled to the outside of the housing, the computer adapted to control the dispensing controllers responsive to user manipulation of the control panel and user manipulation of the user input device to deliver a flavor concentrate and water from the dispensing controllers to the post-mix valve.

4. The beverage dispenser of claim 1, wherein the flow control assembly is coupled to a bracket that is adapted to suspend the flow control assembly in an upper portion of the housing.

5. The beverage dispenser of claim 4, wherein the housing comprises an inner wall including a horizontal rail that extends inward, and the bracket is adapted to engage the rail.

6. The beverage dispenser of claim 1, wherein the flow control assembly is coupled to a bracket that is configured to alternately position the flow control assembly beneath the upper perimeter of the housing and position the flow control assembly above the upper perimeter of the housing, wherein the bracket has a length and the housing has a width, and the length of the bracket is longer than the width of the housing.

7. The beverage dispenser of claim 1, further comprising a quick disconnect assembly for receiving lines from the external fluid sources at first ports and receiving lines to the flow control assembly at second ports.

8. The beverage dispenser of claim 7, further comprising a bracket for the quick disconnect assembly, the bracket attached to the interior of the housing.

9. The beverage dispenser of claim 1, wherein the valve is adapted to receive a line conveying water and a plurality of lines conveying respective flavor concentrates and mix fluids from the concentrate lines with fluid from the water line in the nozzle.

10. The beverage dispenser of claim 1, further comprising a power transformer adapted to receive an alternating current signal and convert it into a direct current signal, the power transformer located outside the housing.

11. A beverage dispenser for engaging an external source of multiple pressurized flavor concentrates and pressurized water, the beverage dispenser comprising:

a housing having a lower perimeter and an upper perimeter;

a lid configured to engage the upper perimeter;

a base configured to engage the lower perimeter;

a post-mix valve coupled to the housing and extending therefrom, the valve comprising a body, a nozzle for dispensing a beverage, and a handle operating member extending upward from the body, the post-mix valve configured to separately receive a flavor concentrate and water and mix the two fluids in the nozzle before dispensing;

a flow control assembly inside the housing, the flow control assembly comprising a multiplicity of paired mechanically adjustable flow control elements and dispensing controllers, the dispensing controllers fluidly coupled to the post-mix valve;

a touch-sensitive control panel mounted to the outside of the housing;

a computer for controlling the dispensing controllers responsive to user touches of the control panel to deliver a flavor concentrate and water from the dispensing controllers to the post-mix valve; and a power transformer configured to receive an alternating current signal and convert it into a direct current signal, the power transformer located outside the housing.

12. The beverage dispenser of claim 11, wherein the base comprises a pocket configured to engage the lower perimeter of the housing so as to hold at least a portion of the lower perimeter in the pocket.

13. The beverage dispenser of claim 11, wherein the post-mix valve comprises a sensor activated by movement of the handle operating member, the computer adapted to control the dispensing controllers responsive to user manipulation of the handle operating member.

14. The beverage dispenser of claim 11, further comprising a user input device coupled to the outside of the housing, the computer adapted to control the dispensing controllers responsive to user manipulation of the user input device to deliver a flavor concentrate and water from the dispensing controllers to the post-mix valve.

15. The beverage dispenser of claim 11, wherein the flow control assembly is coupled to a bracket that is adapted to suspend the flow control assembly in an upper portion of the housing.

16. The beverage dispenser of claim 15, wherein the housing comprises an inner wall including a horizontal rail that extends inward, and the bracket engages the rail.

17. The beverage dispenser of claim 11, wherein the flow control assembly is coupled to a bracket that is adapted to alternately position the flow control assembly beneath the upper perimeter of the housing and position the flow control assembly above the upper perimeter, wherein the bracket has a length and the housing has a width, and the length of the bracket is longer than the width of the housing.

18. The beverage dispenser of claim 11, further comprising a quick disconnect assembly for receiving lines from the external fluid sources at first ports and receiving lines to the flow control assembly at second ports.

19. The beverage dispenser of claim 18, further comprising a bracket for the quick disconnect assembly, the bracket attached to the interior of the housing.

20. The beverage dispenser of claim 11, wherein the valve is adapted to receive a line conveying water and a plurality of lines conveying respective flavor concentrates and mix fluids from the concentrate lines with fluid from the water line in the nozzle.

* * * * *